US008839975B2

(12) United States Patent
Luburic

(10) Patent No.: US 8,839,975 B2
(45) Date of Patent: Sep. 23, 2014

(54) CONTAINER AND LID

(75) Inventor: Frano Luburic, Anaheim, CA (US)

(73) Assignee: Ropak Corporation, Atlanta, GA (US)

( * ) Notice: Subject to any disclaimer, the term of this patent is extended or adjusted under 35 U.S.C. 154(b) by 739 days.

(21) Appl. No.: 12/461,165

(22) Filed: Aug. 3, 2009

(65) Prior Publication Data

US 2011/0024421 A1 Feb. 3, 2011

(51) Int. Cl.

| | |
|---|---|
| ***B65D 51/18*** | (2006.01) |
| ***B65D 43/02*** | (2006.01) |
| ***B65D 50/04*** | (2006.01) |
| ***B65D 43/16*** | (2006.01) |
| ***B65D 25/32*** | (2006.01) |

(52) U.S. Cl.

CPC ..... *B65D 25/32* (2013.01); *B65D 43/0256* (2013.01); *B65D 2543/00296* (2013.01); *B65D 2543/00796* (2013.01); *B65D 2543/00629* (2013.01); *B65D 2543/00759* (2013.01); *B65D 2543/00685* (2013.01); *B65D 2543/00555* (2013.01); *B65D 2543/00194* (2013.01); *B65D 50/046* (2013.01); *B65D 43/161* (2013.01); *B65D 2543/00648* (2013.01); *B65D 2101/0038* (2013.01)

USPC ..... 220/254.3; 220/285

(58) Field of Classification Search

USPC ..... 220/780, 265, 276, 826, 810, 285, 784, 220/270, 283, 266, 786, 254.3, 254.4, 220/258.2; 215/254

See application file for complete search history.

(56) References Cited

U.S. PATENT DOCUMENTS

| | | | | |
|---|---|---|---|---|
| 1,354,211 | A * | 9/1920 | Reed | 206/38 |
| 3,746,206 | A | 7/1973 | Utz | |
| 3,951,290 | A | 4/1976 | Montgomery | |
| 4,071,156 | A | 1/1978 | Lowe | |
| 4,278,178 | A | 7/1981 | Geiser | |
| 4,288,000 | A | 9/1981 | Luker et al. | |
| 4,369,901 | A * | 1/1983 | Hidding | 222/480 |
| 4,512,493 | A | 4/1985 | Von Holdt | |
| 4,732,288 | A | 3/1988 | Morris | |
| 5,284,270 | A | 2/1994 | Kusta | |
| 5,617,968 | A | 4/1997 | Luburic | |
| 5,718,347 | A | 2/1998 | Walker et al. | |
| 5,862,935 | A | 1/1999 | Dubois et al. | |
| 5,871,113 | A | 2/1999 | Conway | |
| 5,979,691 | A | 11/1999 | Von Holdt | |
| 6,161,711 | A | 12/2000 | Miceli et al. | |
| 6,257,441 | B1 | 7/2001 | Maley | |
| 6,318,894 | B1 | 11/2001 | Derenthal | |
| 6,604,647 | B1 | 8/2003 | Luburic | |
| 6,644,492 | B1 | 11/2003 | Mitchell | |
| 6,712,233 | B2 | 3/2004 | Arshinoff | |
| 6,772,902 | B1 | 8/2004 | White | |
| 6,899,245 | B1 | 5/2005 | Nelson | |
| D518,265 | S | 3/2006 | Prokop et al. | |

(Continued)

FOREIGN PATENT DOCUMENTS

WO WO 2006/021034 3/2006

*Primary Examiner* — Jeffrey Allen

(74) *Attorney, Agent, or Firm* — Morris, Manning & Martin, LLP; Daniel E. Sineway, Esq.

(57) ABSTRACT

A container and lid includes: a container body having an opening; a lid body configured to cover the opening of the container body; a lid skirt at a periphery of the lid body, the lid skirt having a tooth slot therein; and a container tooth at a periphery of the container body configured to extend into the tooth slot of the lid skirt.

27 Claims, 22 Drawing Sheets

(56) References Cited

U.S. PATENT DOCUMENTS

| | | | | |
|---|---|---|---|---|
| 7,134,567 | B2 | 11/2006 | Luburic | |
| 2004/0060942 | A1 | 4/2004 | Luburic | |
| 2006/0011631 | A1* | 1/2006 | Dengel et al. | 220/270 |
| 2006/0027581 | A1* | 2/2006 | Vogel et al. | 220/254.3 |
| 2006/0076260 | A1 | 4/2006 | Luburic | |
| 2007/0170192 | A1* | 7/2007 | Blum et al. | 220/826 |
| 2007/0181527 | A1 | 8/2007 | Kaufman | |
| 2008/0000904 | A1 | 1/2008 | Vovan | |
| 2008/0083768 | A1 | 4/2008 | Luburic | |
| 2008/0257886 | A1 | 10/2008 | Luburic | |
| 2009/0032534 | A1 | 2/2009 | Luburic | |
| 2009/0039051 | A1* | 2/2009 | Habitz et al. | 215/256 |

* cited by examiner

CONTAINER AND LID

BACKGROUND

1. Field of the Invention

The present invention relates to containers and lids.

2. Discussion of the Related Art

Containers have been used to sell swimming pool chemical products and other household hazardous products. These containers may be subject to child resistance testing and testing associated with transportation of hazardous materials.

SUMMARY

The present invention is directed to improved containers and lids.

An advantage of the present invention is to provide an improved child resistant container and lid.

Another advantage of the present invention is to provide a container and lid having improved performance during transportation.

Another advantage of the present invention is to provide improved performance during testing associated with transportation of hazardous materials.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a container and lid includes: a container body having an opening; a lid body configured to cover the opening of the container body; a lid hinge configured to allow a pivoting portion of the lid body to open while a remaining portion of the lid body remains closed; a lift tab at a periphery of the pivoting portion of the lid body, wherein the lift tab has a tooth slot therein; a container tooth at a periphery of the container body configured to extend into the tooth slot of the lift tab; one or more first retention hooks along a periphery of the pivoting portion of the lid body; one or more second retention hooks along a periphery of the remaining portion of the lid body; a first bumper portion at a periphery of the container body and having one or more retention slots configured to receive the one or more first retention hooks; a second bumper portion at a periphery of the container body and having one or more retention slots configured to receive the one or more second retention hooks; a tear strip configured to separate the one or more first retention hooks from the pivoting portion of the lid body; a pull lever at a periphery of the pivoting portion of the container body and configured to lift the lift tab, thereby removing the container tooth from the tooth slot in the lift tab; and a lever guard adjacent the pull lever and configured to block the pulling of the pull lever when the lever guard is in a normal state and to allow the pulling of the pull lever when the lever guard is pressed toward the container body.

In another aspect, a container and lid includes: a container body having an opening; a lid body configured to cover the opening of the container body; a lid skirt at a periphery of the lid body, the lid skirt having a tooth slot therein; and a container tooth at a periphery of the container body configured to extend into the tooth slot of the lid skirt.

In an additional aspect, a container and lid includes: a container body having an opening; a lid body configured to cover the opening of the container body; a lift tab at a periphery of the lid body; and a pull lever at a periphery of the container body and configured to lift the lift tab.

In an additional aspect, a container includes: a container body having an opening; a pull lever at a periphery of the container body configured to displace a lid covering the opening of the body; and a lever guard adjacent the pull lever and configured to block the pulling of the pull lever when the lever guard is in a normal state and to allow the pulling of the pull lever when the lever guard is pressed towards the container body.

In an additional aspect, a container includes: a container body having an opening; a pull lever at a periphery of the container body and configured to displace a lid covering the opening of the body; and a push stop between the container body and the pull lever.

In an additional aspect, a container and lid includes: a container body having an opening; a lid body configured to cover the opening of the container body; a lift tab at a periphery of the lid body; and tab guards configured to block lateral sides of the lift tab.

In an additional aspect, a lid includes: a lid body configured to cover an opening of a container body; a lift tab at a periphery of the lid body; and a tab cover configured to prevent the lifting of the lift tab.

In an additional aspect, a lid includes: a lid body configured to cover an opening of a container body; and upper and lower tear lines along a periphery of the lid body defining therebetween a tearstrip.

In an additional aspect, a container and lid assembly includes: a container body having an opening; a lid body covering the opening of the container body; a lid skirt along a periphery of the lid body, wherein the lid skirt is fastened to the container body; and a tearstrip configured to separate the lid skirt from the lid body.

In an additional aspect, a lid includes: a lid body configured to cover an opening of a container body; one or more retention hooks at a periphery of the lid body and configured to hold the lid body to the container body; and a tearstrip configured to separate the one or more retention hooks from the lid body.

In an additional aspect, a container and lid assembly includes: a container body having an opening; a lid body covering the opening of the container body; a lid hinge configured to allow a pivoting portion of the lid body to open while a remaining portion of the lid body remains closed; and a lid skirt portion along a periphery of the remaining portion of the lid body, wherein the lid skirt portion is fastened to the container body.

In an additional aspect, a lid includes: a lid body configured to cover an opening of a container body; a lid hinge configured to allow a pivoting portion of the lid body to open while a remaining portion of the lid body remains closed; and one or more retention hooks at a periphery of the remaining portion of the lid body configured to hold the remaining portion of the lid body to the container body.

In an additional aspect, a container and lid includes: a container body having an opening, the container body have a first side and a second side opposite the first side; a lid body configured to cover an opening of the container body, the lid body have a first side and a second side opposite the first side; a first pull lever at the first side of the container body configured to displace the lid body covering the opening of the container body; one or more retention hooks at a periphery of the lid body; and one or more retention slots at a periphery of the container body configured to receive the one or more retention hooks.

In an additional aspect, a method of opening a container includes: pressing a lever guard toward a container body, thereby creating access to a pull lever; and pulling the pull lever via the created access, thereby displacing a lid covering an opening of the container body.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to embodiments of the present invention, examples of which are illustrated in the accompanying drawings.

Containers include a body having an opening through which contents may be added or removed. The containers may have a base and sidewalls extending upwardly therefrom. The sidewalls may include an upper edge defining an opening to the container, or the opening may be at another portion of the container. The sidewalls may be in the shape of a circle, forming a round container. The sidewall may be include one or more corners and/or straight sidewall portions, forming a container in the shape of, for example, a triangle, square, rectangle, pentagon, hexagon, or octagon. The container may be a round container with a square opening or an oval container with a rectangular opening.

Compared with rectangular or square containers, for example, round containers may take more space on a production line, in a warehouse, in a truck (empty and full) during transportation, and on store shelves. Thus, round containers may be more expensive and less environmentally friendly.

Lids include a body configured to cover the opening of the container and may include a skirt around the periphery of the lid body.

The container and lid may be manufactured from any suitable material, such as a strong and resilient plastic, such as polyethylene or polypropylene, and may be manufactured by any suitable method, such as injection molding or blow-molding. The method may include forming a mold having a cavity having the final or near-final shape of the container or lid and injecting a molten material into the cavity of the mold.

Additional aspects of illustrated embodiments of the present invention will be described below with reference to FIGS. 1-22.

Figure 1:
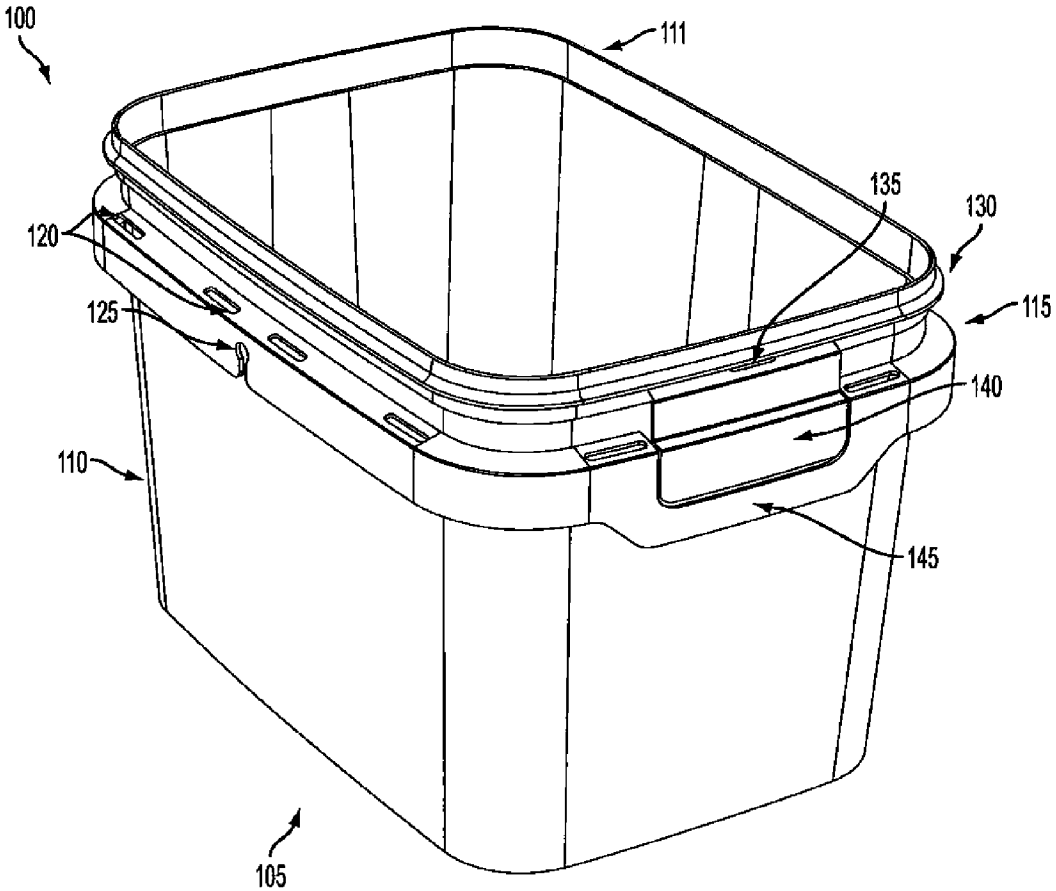
FIG. 1 is a top perspective view of a container according to an embodiment of the present invention.

FIG. 1 is a top perspective view of a container according to an embodiment of the present invention.

As shown in FIG. 1, the container body 100 includes a container base 105 and sidewalls 110. The sidewalls 110 taper outwardly as they extend upwardly such that like containers may be nested inside one another. The sidewalls 110 include an outwardly offset portion 111 near the upper edge of the sidewalls 110.

The container may include a bumper 115 at the outside of the sidewalls 110. As shown, the bumper 115 includes a first flange extending outwardly from the sidewalls 110 and a second flange extending downwardly from the first flange. When a container and lid are assembled, the bumper 115 may extend outward from the sidewalls 110 further than a skirt of the lid. In this case, if the container is dropped on its side, the bumper will absorb the force of the impact rather than the skirt of the lid. Also, when assembled, the bumper 115 may be positioned closely adjacent to a lower edge of a skirt of the lid. In this case, the space between the bumper 115 and the lower edge of the skirt may be minimized to prevent tampering with the container via the underside of the skirt. The space may small enough to prevent insertion of a child's fingers between the bumper and the lid skirt.

The bumper 115 may include retention holes 120. As shown, retention holes 120 are included in the first flange. When the retention holes 120 are present, fasteners may extend into the retention holes 120 and fasten to an underside of the bumper. For example, a lid may be fastened to the bumper 115 via hooks or other fastening devices extending through complementary retention holes 120 in the container. In another aspect, bumper 115 may be fastened to the lid in another manner, such as by applying an adhesive. In another aspect, the container may include retention holes 120 in a non-bumper region of the container.

The bumper 115 may include one or more bail ears 125. As shown, the bail ear 125 is included in the second flange of the bumper 115. A handle 300 (not shown) may attach to the bail ear 125. A second bail ear 125 may be located at another portion of the bumper 115, such as on the opposite side of the container body 100. The handle 300 may be made of plastic or another suitable material.

The container may further include bead 130. As shown, the bead 130 extends around the periphery of the container near the opening of the container. The container bead may extend entirely or partially around the periphery of the container and may include gaps or breaks in the container bead. The cross-section of the container bead may be, for example, round or wedge-shaped. In some aspects, the container bead may include an upper surface, for example, extending outwardly and downwardly. When the container is assembled with a lid, the bead 130 may engage with the lid to hold it in place.

The container may further include a tooth 135. As shown, the tooth 135 protrudes from an upper portion of the outside of the container body 100. The tooth may be above or below a container bead if the container bead is present in the vicinity of the tooth. In one aspect, the tooth may be an extension of the container bead. Alternatively, the tooth may extend more or less than twice as much as the container bead. The tooth may include an upper surface, for example, extending outwardly and downwardly. The lower surface of the tooth may extend, for example, outwardly and upwardly, or outwardly and substantially neither upward nor downward. When the tooth and the bead are both present, the tooth may extend from the sidewall approximately twice as much at the container bead. The length of the tooth may be more or less than the width of the tooth, and the height of the tooth may be less than the length and width. When a lid having a slot is placed on the container, the tooth may extend into or through the slot.

Although not shown, the container may include a second tooth. The second tooth may be positioned at an opposite side of the container. When a lid having a slot is placed on the container, the tooth may extend into or through the slot. In this instance, the first tooth may be positioned at a first side of the container configured to the opened and the second tooth may be positioned at a second side of the container configured to the maintained in place when the first side is opening. The second tooth may provide stronger engagement of the lid to the container at the second side.

The container may include a pull lever 140. As shown, the pull lever 140 is included at an upper outside portion of the container body 100. The pull lever 140 is attached to the sidewall 110 at an upper end of the pull lever 140 as shown in FIG. 1. The pull lever 140 has a free end at a lower end of the pull lever 140. When the free end of the pull lever 140 is pulled, the lever 140 pivots near the attached end of the pull lever 140, thereby lifting the free end of pull lever 140. When the container is assembled with a lid, the pull lever 140 may lift the lid thereby disengaging the lid from the container.

The container may include a lever guard 145 positioned around the pull lever 140. The lever guard 145 includes portions at the lateral sides of the pull lever 140 and at a portion below the pull lever 140. Between the pull lever 140 and the lever guard 145 is a gap. The gap is designed to be small enough to prevent insertion of a child's fingers. The lever guard 145 may be flexible enough to allow a user to press a portion of the lever guard 145 towards the container body 100, thereby creating a space between the lever guard 145 and the pull lever 140, such that a user may insert one or more fingers in the created space and pull the pull lever 140. As illustrated, the lever guard 145 may be an extension of a bumper 115 of the container.

Although not illustrated, the container may include a second pull lever 140 and/or a second lever guard 145 on an opposite side of the container. As such, the container may provide for a symmetry that allows a lid to be assembled to the container in either direction and provide for the same results.

Figure 2:
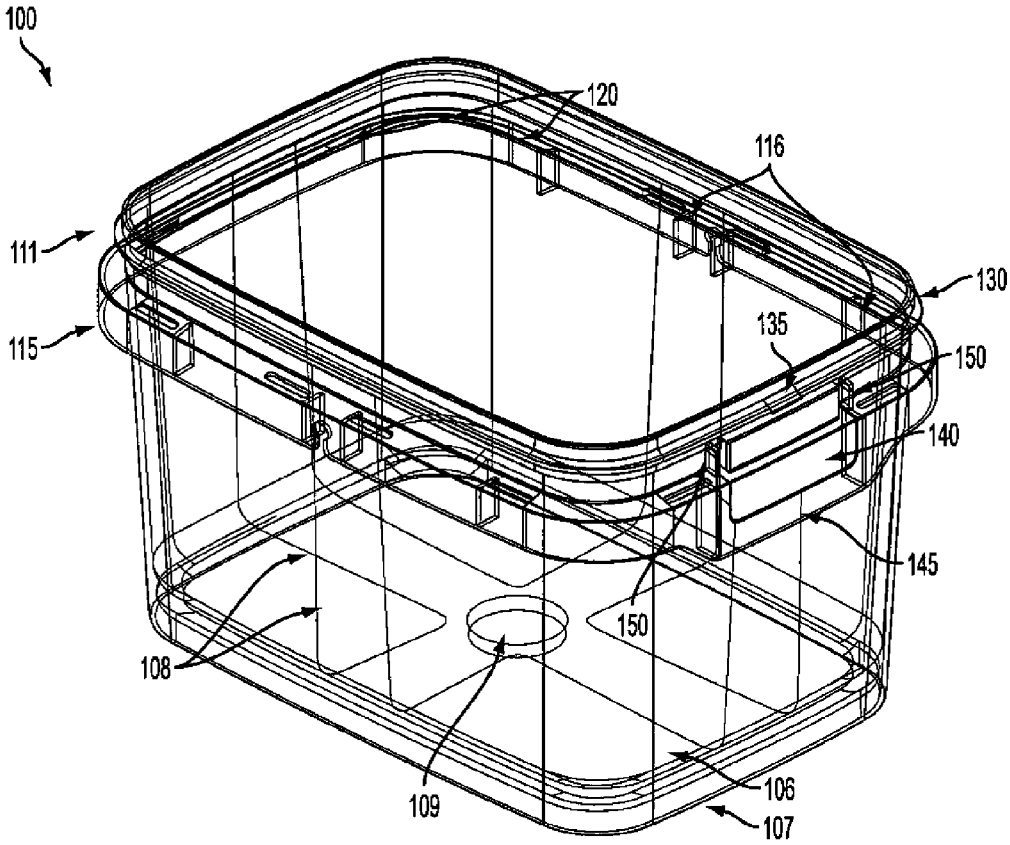
FIG. 2 is a see-through top perspective view of a container according to an embodiment of the present invention.

FIG. 2 is a see-through top perspective view of a container according to another embodiment of the present invention. Similar to the container of FIG. 1, the container may include sidewalls 110, an outwardly offset portion 111 of the sidewalls 110, a bumper 115, retention holes 120, a bail ear 125, a container bead 130, a container tooth 135, a pull lever 140, and a lever guard 145.

As further shown in FIG. 2, one embodiment of the container may include a central base portion 106 and a peripheral base portion 107. The central base portion 106 may be elevated with respect to the bottom of the sidewalls 110. The peripheral base portion 107 surrounds the central base portion 106 and curves upwardly and outwardly until the peripheral base portion connects with the sidewalls 110. As viewed from below the container, the peripheral base portion has a convex shape. In some aspects, the container may be stacked onto a lid. When the container includes the elevated central base portion 106, the lid may include raised portions in a central portion of the lid without interfering with the stackability of the container.

As illustrated, in one aspect, the central base portion 106 includes a gate site 109 and flow leaders 108. As viewed from below the container, the gate site 109 has a concave shape and as viewed from above the container, the gate site 109 has a convex shape. The flow leaders 108 extend outward from the gate site 109 to the sidewalls 110. As viewed from above the container, the flow leaders 108 form regions of increased wall thickness of the central base portion 106.

Additionally, the container tooth 135 of the embodiment illustrated in FIG. 2 has an upper surface that slopes outwardly and downwardly and has a generally horizontal bottom surface. When a container having the container tooth 135 is assembled with a lid, the container tooth 135 may engage with the lid to hold the lid in place. In FIG. 2, the pull lever 140 may be lifted to thereby lift a portion of the lid engaged with the tooth 135, thereby disengaging the lid from the container tooth 135 and allowing the lid to be removed from the container.

Furthermore, the container of FIG. 2 includes a bumper 115 and bumper supporting ribs 116. The bumper supporting ribs 116 may be positioned between the bumper 115 and the sidewalls 110. As shown, the bumper supporting ribs 116 connect to the sidewalls 110 and to upper and outer flanges of the bumper 115. In a side of the container including the lever guard 145, bumper supporting ribs 116 may be positioned at either side of the lower portion of the lever guard 145 and may be omitted at the portion of the lever guard below the pull lever 140. As such, the bumper supporting ribs 116 may support the bumper 115 and lever guard 145 without interfering with the ability of the lever guard to be pressed towards the sidewalls 110 of the container.

When the container includes bumper supporting ribs 116 and retention holes 120, the bumper supporting ribs 116 may be strategically located to avoid crossing the retention holes 120. Also the bumper supporting ribs 116 may be strategically located closely adjacent to the retention holes 120 to strengthen a portion of the bumper 115 that may otherwise be weak due to the presence of the retention holes 120.

The container of FIG. 2 may include tab guards 150. As shown, the tab guards 150 connect to the bumper 115 and the sidewalls 110. When a lid is assembled with the container, the tab guards 150 may be positioned to block access to lateral portions of a space between a lift tab of a lid and the sidewall 110 of the container.

Figure 3:
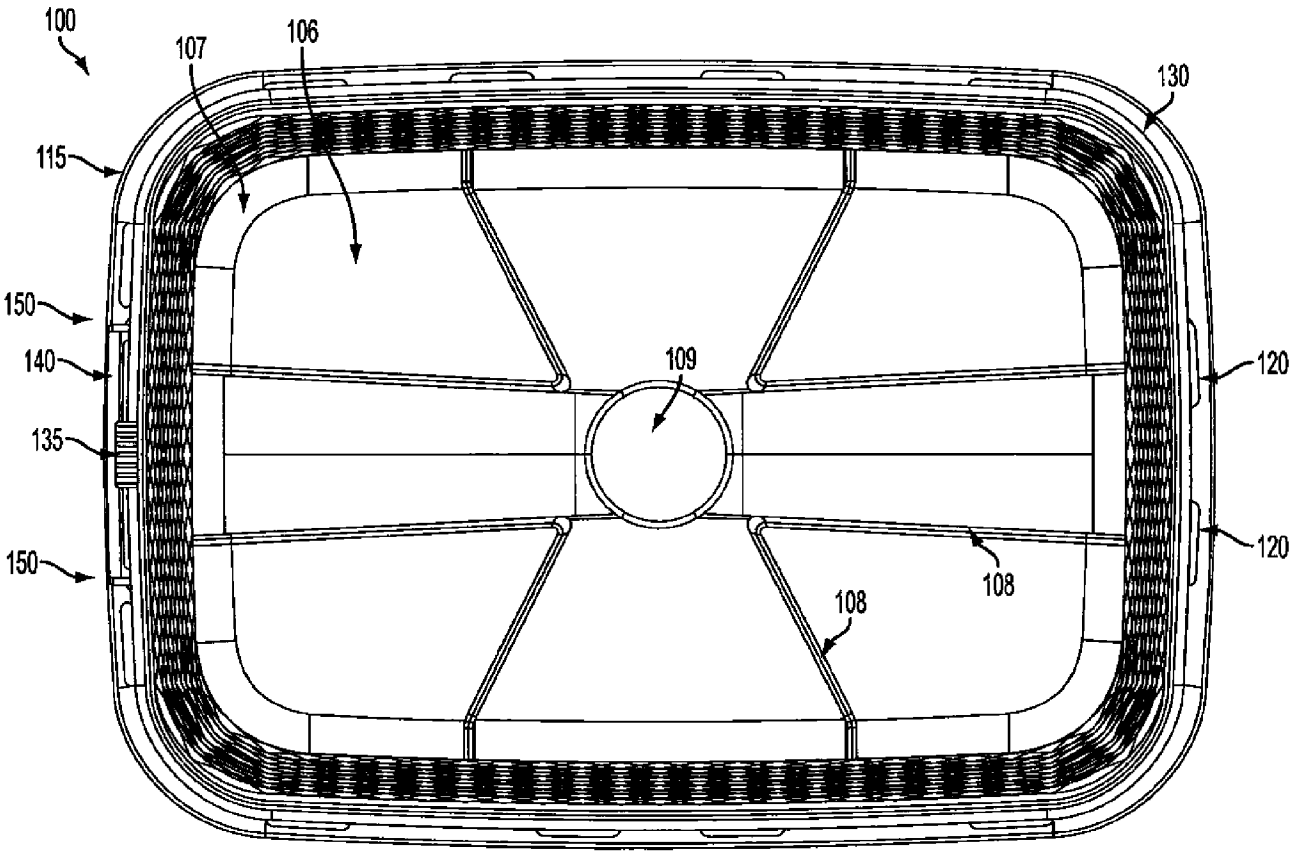
FIG. 3 is a top view of a container according to an embodiment of the present invention.

FIG. 3 is a top view of a container according to an embodiment of the present invention.

As shown in FIG. 3, the container may include a central base portion 106 and a peripheral base portion 107 between the central base portion 106 and sidewalls 110 of the container. The interior of the sidewalls 110 may include a strengthening web. The strengthening web includes channels having an increased wall thickness as compared to adjacent non-web portions. In certain embodiments, the strengthening web may be arranged in the shape of a repeating pattern of diamonds.

If the container is formed by, for example, injection molding, flow leaders 108 in the central base portion 106 may facilitate a faster flow of molten material from a gate site 109 to the web of channels in the sidewalls 110.

Figure 4:
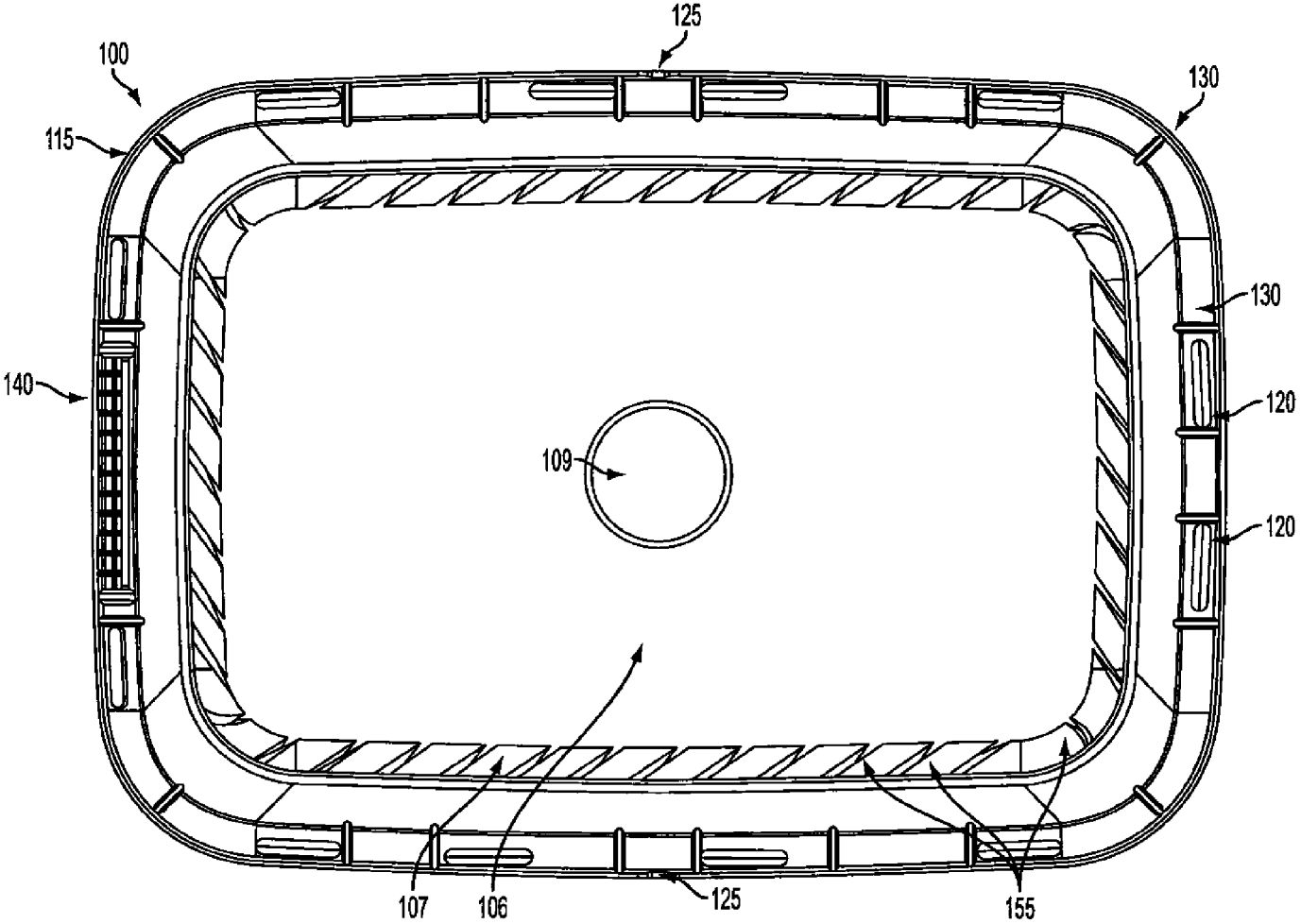
FIG. 4 is a bottom view of the container of FIG. 3.

FIG. 4 is a bottom view of the container of FIG. 3.

As shown in FIG. 4, the container may include base strengthening ribs 155 at the peripheral base portion 107. The base strengthening ribs 155 may be positioned in a space between sidewalls 110 and upwardly curved peripheral base portion 107. The base strengthening ribs 155 connect to the sidewalls 110, the peripheral base portion 107 and a junction formed by the sidewalls 110 and the peripheral base portion 107. Further, the base strengthening ribs 155 may be arranged to be non-perpendicular to the sidewalls 110 of the container.

Figure 5:
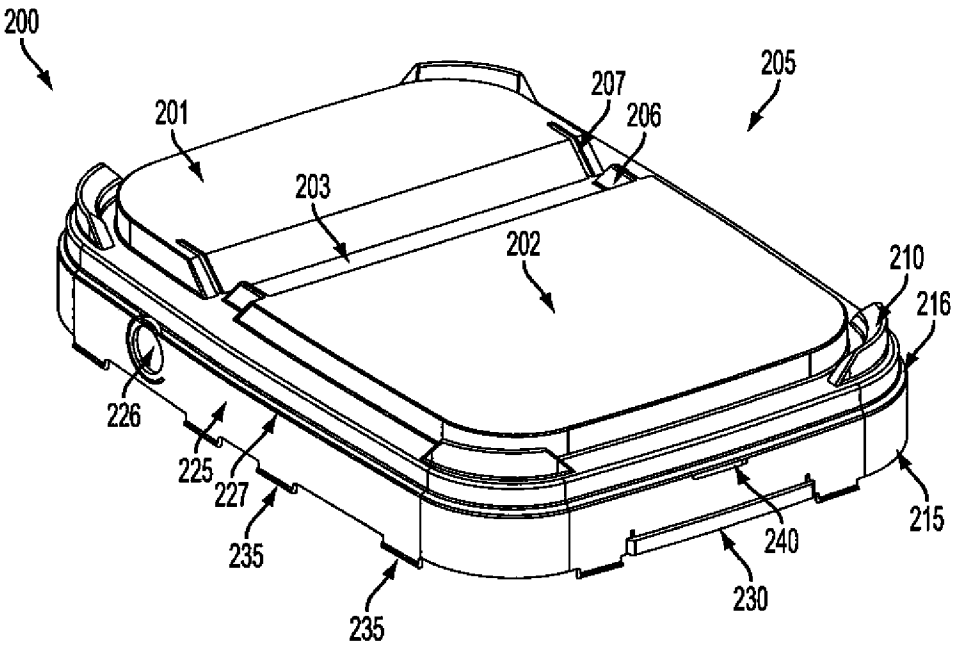
FIG. 5 is a top perspective view of a lid according to an embodiment of the present invention.

FIG. 5 is a top perspective view of a lid according to an embodiment of the present invention.

As shown in FIG. 5, the body 200 of the lid may include a first raised portion 201 and a second raised portion 202 and a valley portion 203 therebetween. As illustrated, the first raised portion 201 and second raised portion 202 include generally horizontal top surface, generally vertical side surfaces near the periphery of the lid, and angled surfaces facing each other.

In some aspects, a container may be stacked on the lid body 200. If the container has an elevated central base portion, the first and second raised portions 201 and 202 may extend upward toward the central base portion. The container may have sidewalls extending around the first raised portion 201 and second raised portion 202. In this case the side surfaces of the first raised portion 201 and second raised portion 202 may be closely adjacent or abut the inside surfaces of the container sidewalls. As such, the containers resist sliding off of the lid after stacking.

The lid may include stacking guides 210. As shown, the stacking guides 210 are formed at the four corners of the lid but may be formed at fewer than four corners or at least one location on a non-rectangular lid. The stacking guides 210 are designed to guide a base of a container that corresponds to the lid. When the container base is placed on the lid, the stacking guides 210 guide the container base such that the sidewalls fit between the stacking guides 210 and the first and second raised portions of the lid. Further, the stacking guides 210 may include upper surfaces which are sloped downward and inward to assist in guiding the containers to an appropriate stacked position.

The lid may include a lid hinge 205. If the valley portion is present on the lid, the lid hinge 205 may be positioned in the vicinity of the valley portion 203 or in another portion. The hinge 205 permits the lid to pivot. As shown, the second raised portion may be lifted and thereby pivot toward the first raised portion. When the second raised portion is lifted to the first, the angle surface of the second raised portion 201 is moved toward that of the first raised portion 202. In one aspect, the angles of the surfaces are between about 30 and 60 degrees. Although not shown, the lid may further include a second hinge 205.

In one embodiment, the lid hinge 205 may be positioned along a length of a container at approximately one third of the length of a side. As such, two thirds of the lid may pivot or one third of the lid may pivot along the lid hinge 205. However, the lid hinge 205 may be positioned at other positions of the lid.

The lid may include hinge locking ribs 206 and hinge locking slots 207. In one aspect, the hinge locking ribs 206 may have a thickness approximately the same as the thickness of other portions of the lid body 200.

As shown, the hinge locking ribs 206 extend from the second raised portion 202 into the valley portion 203, and the hinge locking slots 207 are formed in the first raised portion 201. Alternatively, the hinge locking ribs 206 may extend from the first raised portion 202 and the hinge locking slots 207 may be formed in the second raised portion 201.

As illustrated, when the second raised portion 202 is pivoted to the first raised portion 201, the hinge locking ribs 206 extend into and are held by the hinge locking ribs 207, and the pivoted portion of the lid is held in place until and user pulls the lid closed.

The lid may include an outer skirt 215. As shown, the outer skirt 215 includes a skirt ledge 216 at which the skirt 215 is outwardly offset below the skirt ledge 216. When one lid is stacked on top of another lid, the lower edge of the outer skirt 215 of the first lid may rest on the skirt ledge 216 of the second lid. When the lid is assembled with a container, the lower edge of the outer skirt 215 may abut or be closely adjacent to a bumper of the container. A gap between the outer skirt 215 and the bumper may be minimized to prevent tampering via the underside of the skirt.

The lid may include a tear strip 225. In the illustrated embodiment, if an attempt is made to tamper with the contents of the container, evidence of the tampering would be evident in the state of the tear strip 225, such as a portion of the tear strip 225 being torn or bent. In addition or in place of the tear strip 225, other forms of tamper evidency may be employed. For example, tape, a shrink wrap, or shrink band may be wrapped around the container periphery.

As illustrated, the lid may include a pull ring 226 and an upper tear line 227. Although not shown in this figure, the tear strip 225 and/or the remainder of the outer skirt 215 may include a lid underhang 250 on their interiors. The lid underhang 250 may, for example, include an upper surface of a protrusion extending from the interior or may include an upper surface of a cut-out portion of the interior.

When the lid is assembled with a container, the lid underhang 250 may engage with the container, thereby holding the lid to the container. In some aspects, the container may include a bead. In this instance, the lid underhang 250 may engage with the container bead, thereby firmly holding the lid to the container.

In certain aspects, when the lid is assembled to the container, the lid may be difficult or impossible to pull off the container. In this instance, the tear strip 225 may be removed. As such, after removal of the tear strip 225, any lid underhang 250 on the tear strip 225 may no longer be in engagement with the container, and the entire lid or a portion of the lid may be lifted from the container. As such, removal the tear strip 225 and subsequent removal of the lid may not require any or minimal amount of tools.

According to one aspect, the tear strip 225 may start approximately ¼ of the distance from one corner and tear away the remaining ¾ of the side, all of the adjoining side and ¾ of a further adjoining side. The portion that is not torn away, i.e. parts of 2 opposite sides and all of the side that joins them, is attached and creates the hinge from which the pivoting portion of the lid swings open and closed.

When the lid includes a tear strip 225 and a hinge 205, removal of the tear strip 225 may allow a portion of the lid to be lifted and pivoted at the hinge 205, while a remaining portion of the lid remains engaged to the container.

The lid may include retention hooks 235. As illustrated, the retention hooks 235 extend downward from a bottom edge of the lid skirt 215 and include an outwardly extending catch 236. When multiple lids are stacked together, the outwardly extending catch 236 of the top lid extends away from the lid skirt 215 of the lower lid. The retention hooks 235 may alternatively or additionally include other catches, such as an inwardly extending catch 236.

If the lid is assembled to a container, the retention hooks 235 may extend into retention holes of the container. In this instance, when the lid is being assembled to the container, the retention hooks 235 flex inwardly as the hooks 235 pass through the retention holes. Then after the catch 236 of the retention hooks 235 passes through the holes, the retention hooks may rebound outwardly, thereby positioning the catch 236 of the retention hooks 235 below an edge of the retention holes. After assembly, lifting of the lid from the container may become difficult or impossible due to the holding of the retention hooks 235 within the retention holes 120.

When the lid includes retention hooks 235 and a lid hinge 205, the retention hooks 235 may be strategically located close to the lid hinge 205. In this manner, the retention hooks 235 may strengthen the retention force of an area of the lid that would be otherwise weak.

When the lid includes retention hooks 235 and a tear strip 225, the tear strip 225 may be positioned to separate the retention hooks 235 from all or a remaining portion of the lid body 200.

After the tear strip 225 is removed, the entire lid or a portion of the lid may be lifted from the container. When the lid includes a tear strip 225, a hinge 205 and retention hooks 235, the tear strip 225 may allow a portion of the lid to be lifted and pivoted at the hinge 205, while a remaining portion remains connected to the container at least partly or mostly by the retention hooks 235.

In one embodiment, the container may have a first side and a second side, and a lid may have a first side and a second side. There may be a first pull lever 140 at the first side of the container, one or more retention hooks 235 at a periphery of the lid body 200, and one or more retention slots 120 at a periphery of the container body 100. In case of only the first pull lever 140, the retention hooks 235 and retention slots 120 may be asymmetrically positioned to engage each other when the first side of the lid body 200 covers the first side of the container body 100 but not when the first side of the lid body 200 covers the second side of the container body 100. As such, during assembly the lid may not be incorrectly placed on the container.

On the other hand, the container may include a second pull lever 140 at the second side of the container body 100. In this case, retention hooks 235 and retention slots 120 may be symmetrically positioned to engage each other when the first side of the lid body 200 covers the first or the second side of the container body 100. As such, during assembly the lid may be correctly placed on the container in either manner.

The lid may include a tooth slot 240. As shown the tooth slot 240 extends from the inside surface to the outside surface of the lid skirt 215. When the lid is assembled to a container, a container tooth 135 may extend into or through the tooth slot 240. When the container includes a pull lever 140, the pull lever 140 may be lifted to thereby lift a portion of the lid having the tooth slot 240, thereby removing the container tooth 135 from the tooth slot 240 and allowing the lid or a portion of the lid to be removed from the container.

Although not shown, the lid may include a second tooth slot 240 at an opposite side of the lid. As such, when the lid is assembled to a container, a second container tooth 135 may extend into or through the second tooth slot 240.

Figure 6:
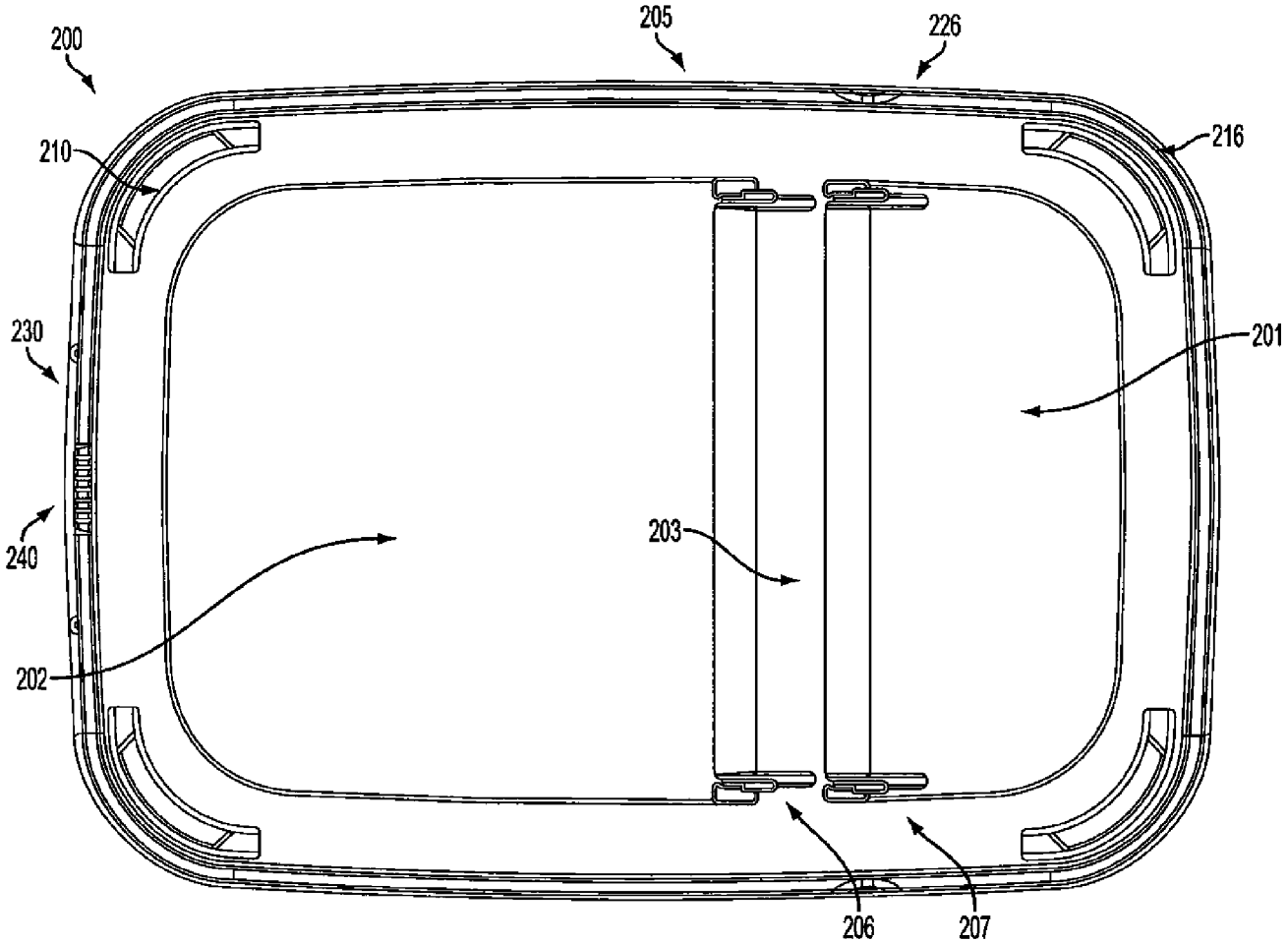
FIG. 6 is a top view of a lid according to an embodiment of the present invention.
Figure 7:
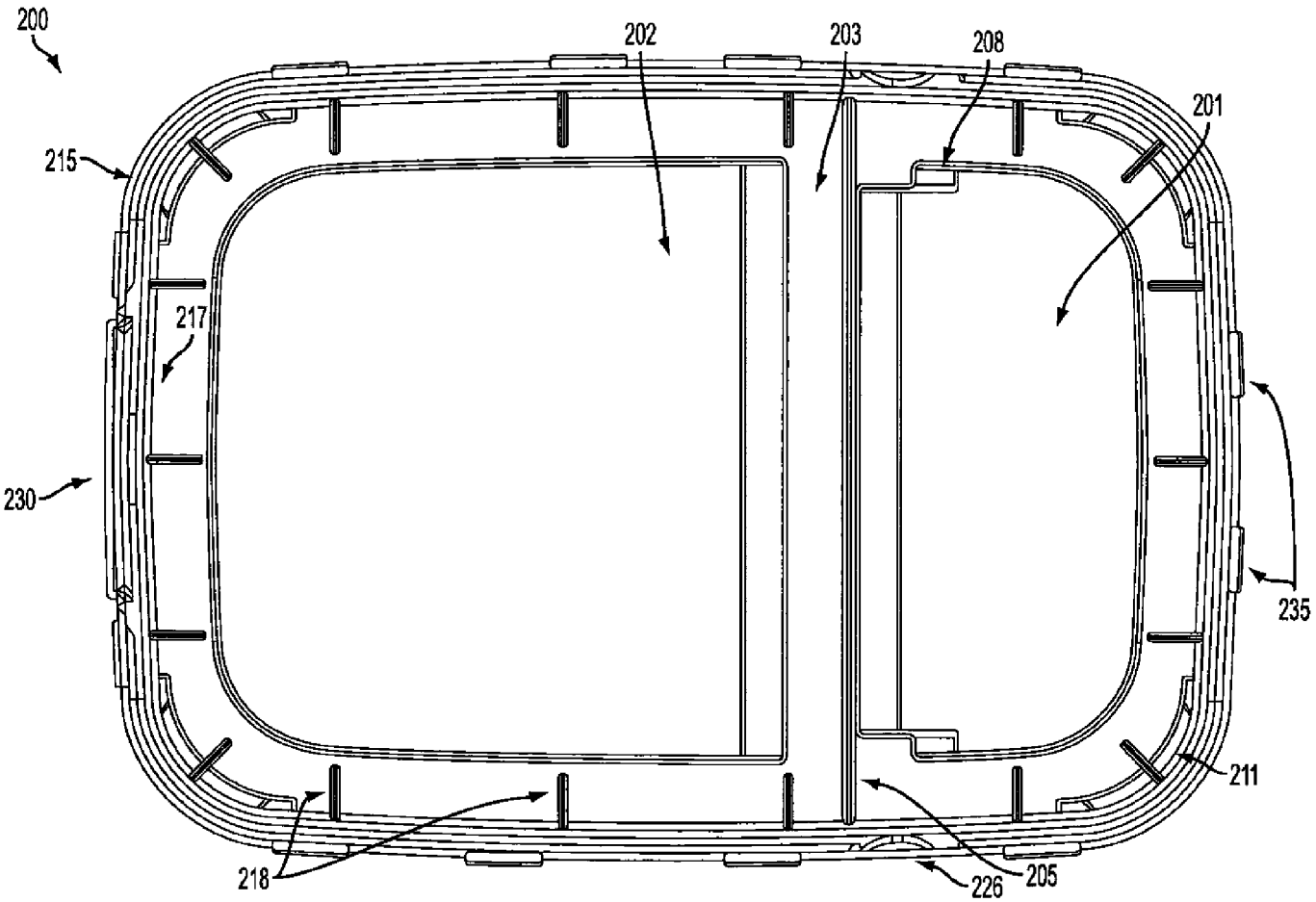
FIG. 7 is a bottom view of the lid of FIG. 6.

FIG. 6 is a top view of a lid according to an embodiment of the present invention, and FIG. 7 is a bottom view of the lid of FIG. 6.

As shown in FIG. 6, the lid includes features similar to FIG. 5, including first raised portion 201, second raised portion 202, valley portion 203, lid hinge 205, hinge locking ribs 206, hinge locking slots 207, stacking guides 210, outer skirt 215 and skirt ledge 216.

As shown in FIG. 7, the lid may further include an inner skirt 217 and inner skirt supporting ribs 218. The inner skirt supporting ribs 218 may connect to the underside of the lid body 200 and to the inner skirt 217. In one aspect, the inner skirt supporting ribs 218 have a thickness less than the thickness of the inner skirt 217.

The lid may further include locking slot housings 208. The locking slot housings 208 correspond to the position of the hinge locking slots 207.

The lid may further includes stacking guide slots 211. The stacking guide slots 211 protrude into the underside of the lid and correspond to a space in the center of the stacking guides 210, forming hollow spaces in the stacking guides 210. As such, the stacking guides 210 having the stacking guide slots 211 may be formed of walls have substantially the same thickness as the remainder of the lid body 200.

Figure 8:
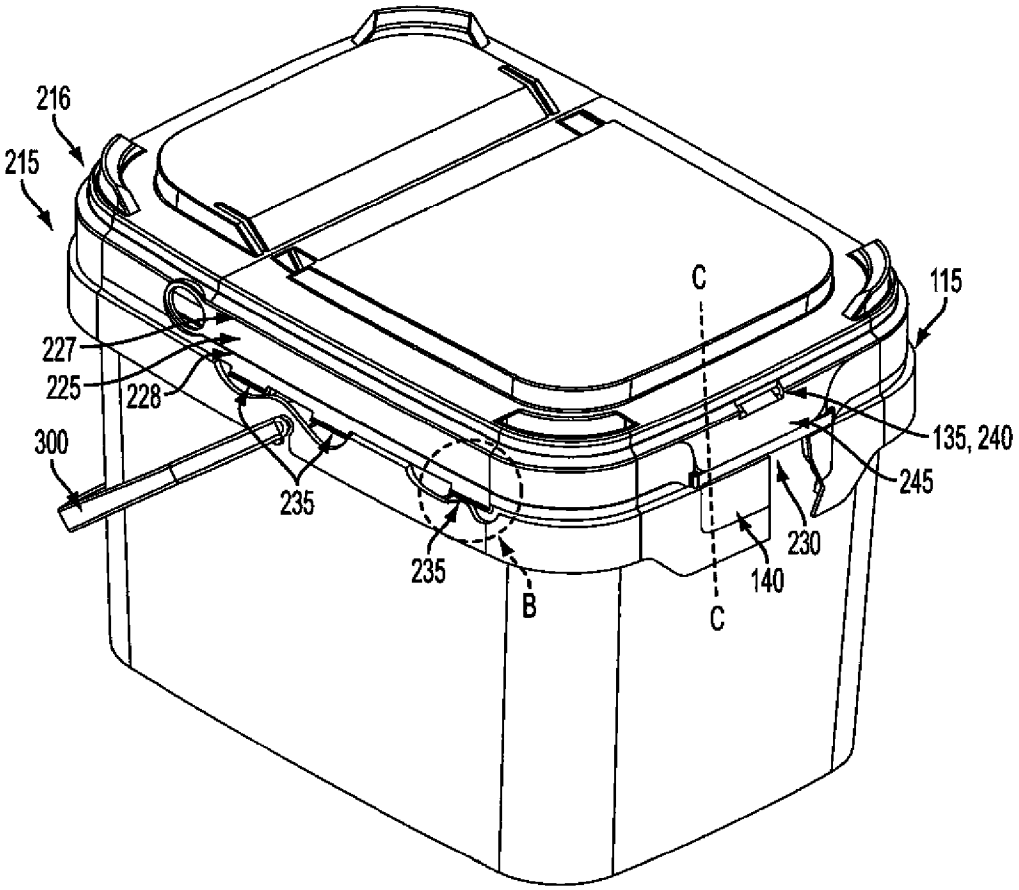
FIG. 8 is a top perspective view of a container and lid assembly according to an embodiment of the present invention.

FIG. 8 is a top perspective view of a container and lid assembly according to an embodiment of the present invention.

As shown in FIG. 8, a lid is fastened to the container. In particular, retention hooks 235 are extended into retention holes 120 to hole the lid to the container. A tear strip 225 includes an upper tear line 227 and a lower tear line 228. The portion of the lid skirt 215 below the lower tear line 228 is connected to the retention hooks 235. When the tear strip 225 is removed, the retention hooks 235 hooks below the lower tear line 228 are separated from a pivoting portion of the container lid 200.

As shown, the lid skirt 215 is closely adjacent to or abutting a bumper 115 of the container. In one aspect, the lid skirt 215 and the bumper 115 are configured so that a space therebetween is small enough to prevent tampering with the underside of the lid. Also, the bumper 115 may extend from the sidewalls 110 of the container further than the lid skirt 215. In this instance, if the container is dropped to its side, the bumper 115 will absorb the force of the impact rather than the lid skirt 215.

Also as shown, the tear strip 225 extends from around a corner of the lid body 200 to a lift tab 245. The upper tear line 227 may extend around the corner of the lid body 200 to the lift tab 245 and form a tear line between the tear strip 225 and the lift tab 245. In this instance, the upper tear line 227 connection between the tear strip 225 and the lift tab 245 may prevent the lift tab 245 from being lifted until after the tear strip 225 is removed.

In another aspect, the tear strip 245 may be separate from the tear strip 225, such that the upper tear line 227 ends near the lift tab 245.

Furthermore, FIG. 8 illustrates a tab cover 230 covering a portion of the lift tab 245. The tab cover 230 may be connected with or separated from the lift tab 245. The tab cover may be frangibly or non-frangibly connected to the tear strip 225. In one aspect, the tab cover 230 is separated from the lift tab 245 and non-frangibly connected to the tear strip 225. As such, when the tear strip 225 is removed, the tab cover 230 is removed with the tear strip 225. In another aspect, the tab cover 230 may be frangibly connected to the tear strip 225 and non-frangibly connected to the lift tab 245, such that when the tear strip is removed, the tear strip 225 disconnects from the tab cover 230 and the tab cover 230 remains connected to the lift tab 245.

Prior to removal of the tear strip 225, the tab cover 230 prevents the lift tab 245 from being lifted outward. As such, engagement of a lid underhang of the lift tab 245, a container bead 130 corresponding to the lift tab 245 or a container tooth 135, may prevent the lid from being lifted from the container.

Figure 9:
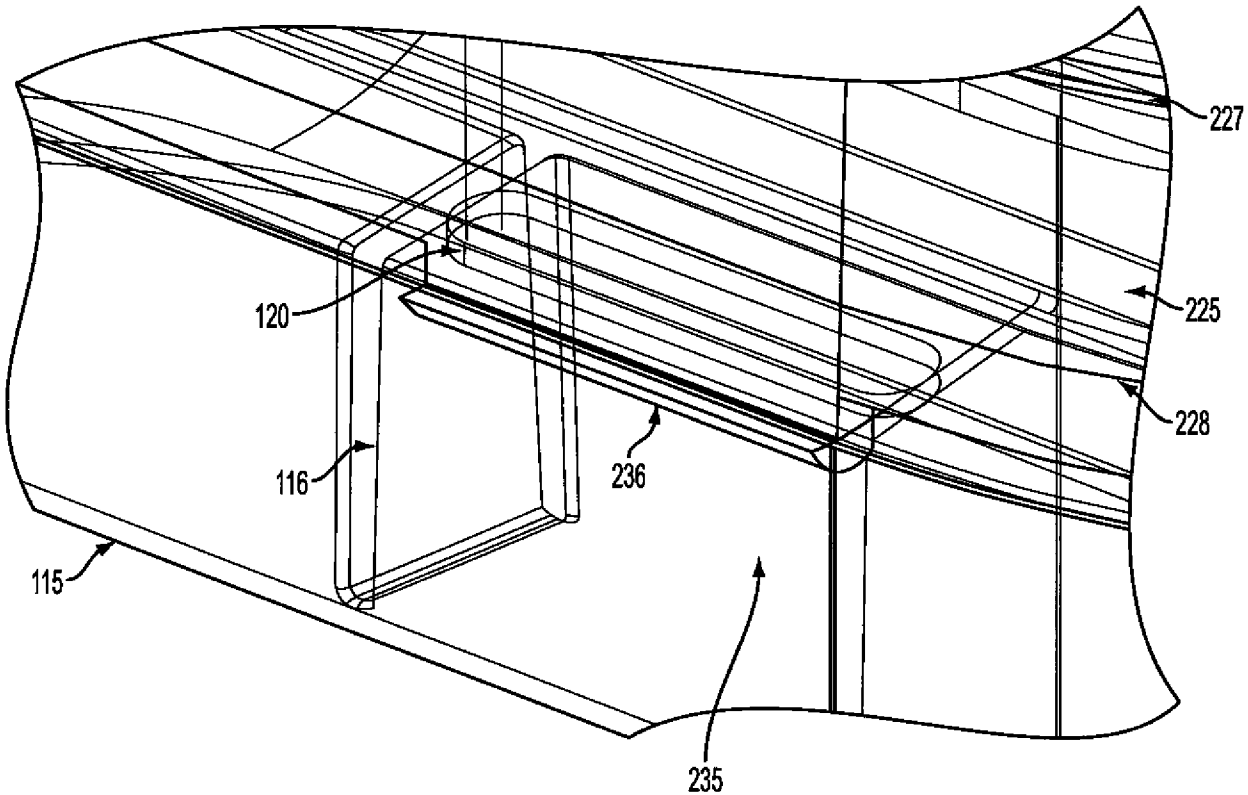
FIG. 9 is a zoomed-in see-through top perspective view of the portion label B in FIG. 8.

FIG. 9 is a zoomed-in see-through top perspective view of the portion label B in FIG. 8.

As shown in FIG. 9, a bumper 115 includes a bumper supporting rib 116. The bumper supporting rib 116 may be connected between upper and outer flanges of the bumper 115 and the sidewall 110. As shown, the bumper 115 includes a retention hole 120. According to one aspect, the portion of the bumper 115 including the retention hole 120 is weakened due to the presence of the retention hole 120. A bumper supporting rib 116 may be positioned adjacent to the retention hole 120 to strengthen the portion of the bumper 115 including the retention hole 120.

As shown in FIG. 9, a tear strip 225 includes an upper tear line 227 and a lower tear line 228. A retention hook 235 may be included at a lower portion of the lid skirt 215 below the tear strip 225. As shown, the retention hook 235 includes a catch 236. In other embodiments, the retention hook 225 may be formed in multiple parts, wherein a catch 236 is snapped onto or adhered onto a portion of the retention hook 225 extending into a retention hole 120. The catch 236 may alternatively or additionally extend in other directions.

Figure 10:
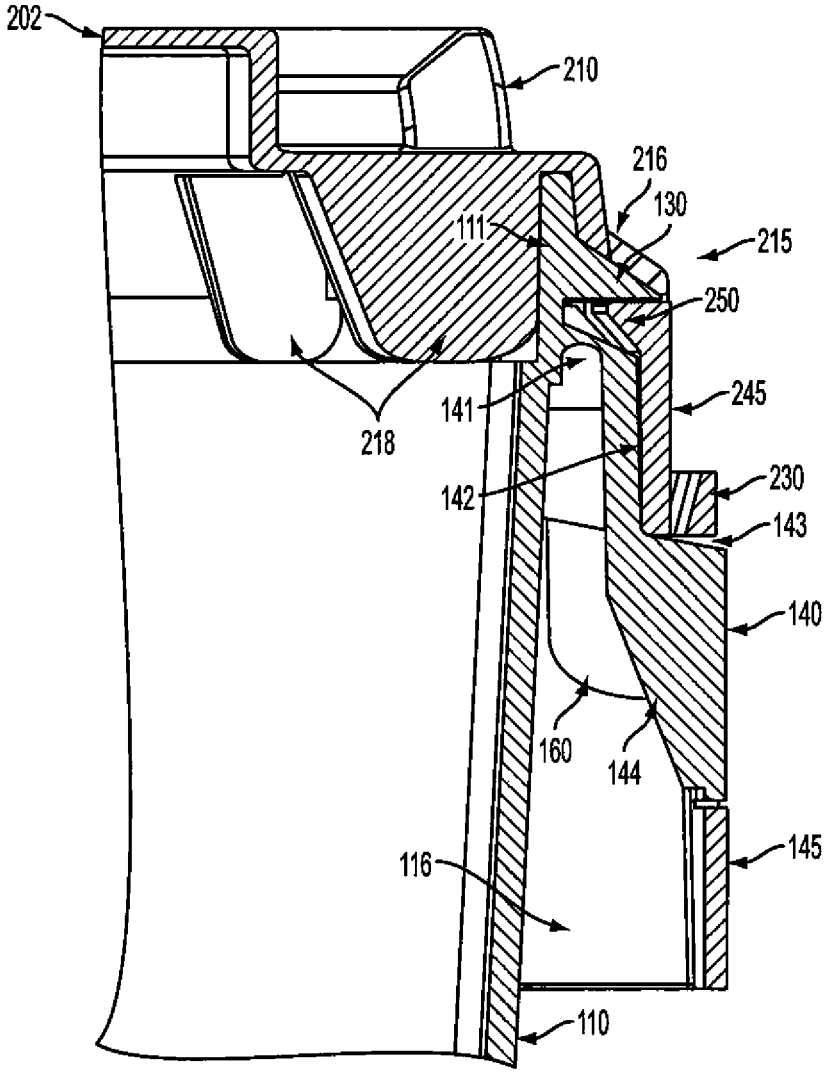
FIG. 10 is a partial sectional view of the container and lid assembly of FIG. 8 approximately along a line marked C-C in FIG. 8.

FIG. 10 is a partial sectional view of the container and lid assembly of FIG. 8 approximately along a line marked C-C in FIG. 8.

As shown in FIG. 10, the sidewalls 110 include an outwardly offset portion 111 near the upper edge of the sidewalls 110. The container includes a container bead 130. As illustrated, the container bead 130 extends from the outwardly offset portion 111 of the sidewalls 110 and includes an upper surface sloping downwardly and outwardly and a generally horizontal lower surface.

The container further includes a pull lever 140. The pull lever 140 may include a lever axis 141 about which the pull lever 140 pivots. The pull lever 140 may include an upper front surface 142 and a ledge surface 143. The lever axis 141 may be a thinned portion that allows the pull lever 140 to pivot repeatedly without breaking.

In another aspect, the pull lever 140 may be attached to, for example, a flange, rib or block on the outside of the container. The pull lever 140 may be connected to the sidewall 110 at, for example, a middle portion of the pull lever 140 or a tip of the pull lever 140.

The container may further include a push stop 160. The push stop 160 may be formed between the pull lever 140 and the sidewalls 110. As shown, the push stop 160 is connected with the pull lever 140. In other aspects, the push stop 160 may be connected with the sidewalls 110 and/or lever guard 145. The push stop 160 may function to prevent the pull lever 140 from being pushed inward by a user. In one embodiment, the push stop 160 may include ribs extending from the pull lever 140 towards the sidewalls 110, but not being attached to the sidewalls 110.

The container may further include a lever guard 145. FIG. 10 shows that the lever guard 145 may be closely adjacent to the pull lever 140 such that a user, particular a child, may not insert their fingers between the pull lever 140 and lever guard 145.

As illustrated in FIG. 10, the lid includes a lid skirt 215 having a skirt ledge 216, a lid underhang 250, and lift tab 245. In one aspect, when the pull lever 140 is lifted, the upper front surface 142 of the pull lever 140 lifts the lift tab 245 outward while the ledge surface 143 of the pull lever 140 lifts the lift tab 245 upward. In another embodiment, the ledge surface 143 of the lift tab 245 may be further spaced from the pull lever 140, such that the lift tab 245 is first lifted outward by the upper front surface 142 before being lifted upward by the ledge surface 143. FIG. 10 further shows a tab cover 230 may be connected to the lift tab 245.

Figure 11:
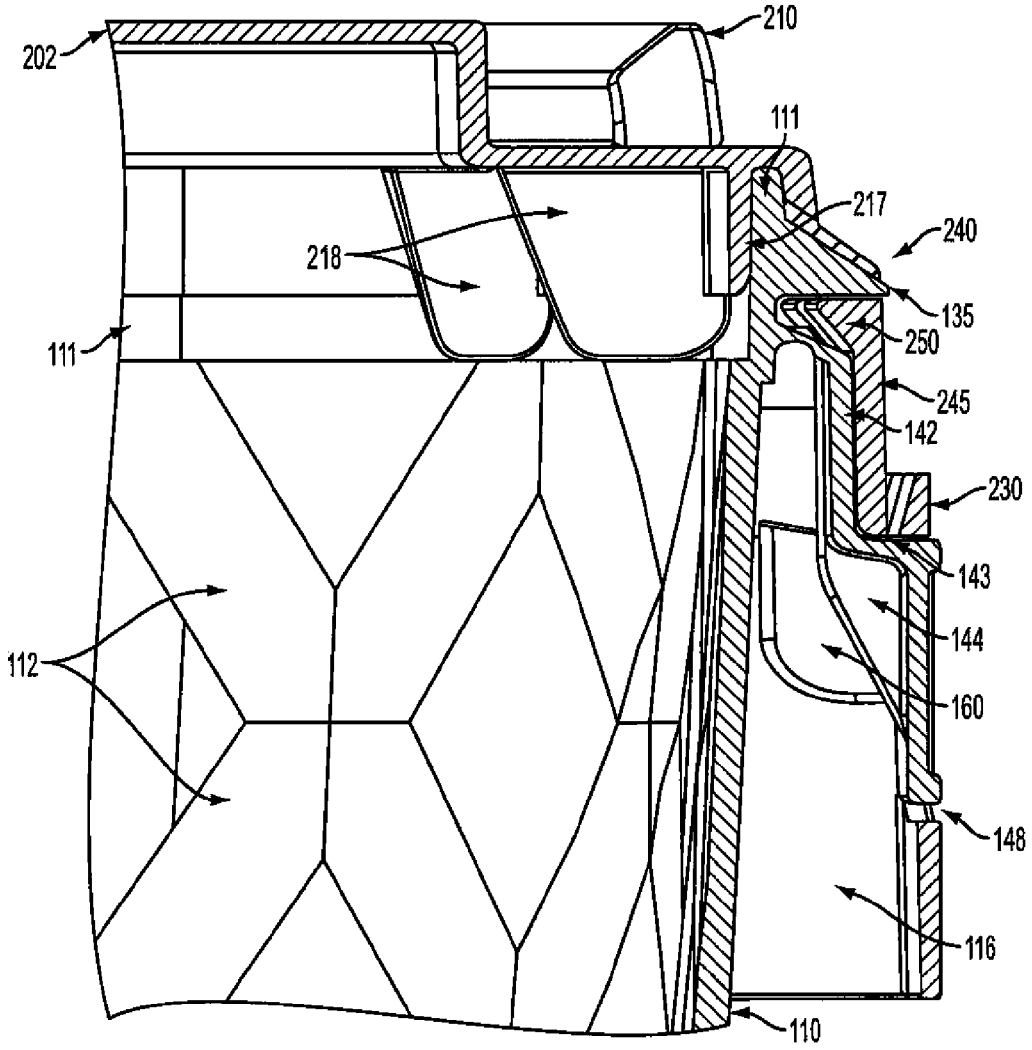
FIG. 11 is a partial sectional view of a container and lid assembly though a portion corresponding to a container tooth.

FIG. 11 is a partial sectional view of a container and lid assembly though a portion corresponding to a container tooth.

As shown in FIG. 11, the container sidewalls 110 may include a strengthening web of raised channels formed in the interior of the container sidewalls 110. The vertical and horizontal lines in the strengthening web are the result of curved webs intersecting each other.

FIG. 11 further illustrates a container tooth 135 extending into and through a tooth slot 240.

A lever strengthening rib 144 may be observed by comparing FIGS. 10 and 11. In FIG. 10, the sectional is taken through the lever strengthening rib 144, and in FIG. 11, the sectional is taken adjacent the lever strengthening rib 144. As shown, the lever strengthening rib 144 is connected to the back of the pull lever 140.

Also shown in FIG. 11, a frangible connector 148 may connect between the pull lever 140 and the lever guard 145. In other aspect, second or more frangible connectors may be connected at other portions of the pull lever 140 or the lift tab 245.

Figure 12:
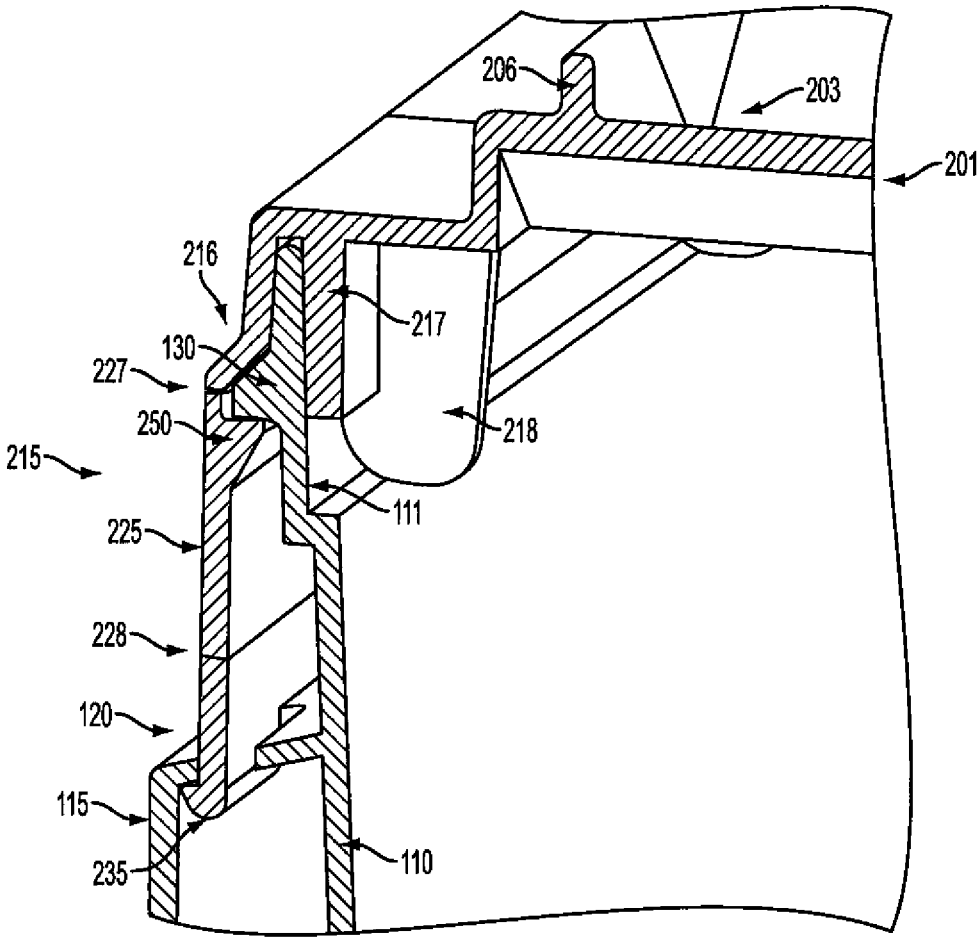
FIG. 12 is a partial sectional view of a container and lid assembly through a portion corresponding to a retention hook.

FIG. 12 is a partial sectional view of a container and lid assembly through a portion corresponding to a retention hook.

As shown in FIG. 12, the container sidewalls 110 include an outwardly offset portion 111 near the upper edge of the sidewalls 110. The container includes a container bead 130 and bumper 115. The bumper 115 includes a retention hole 120.

As illustrated in FIG. 12, the lid includes an outer lid skirt 215, an inner lid skirt 217, an inner lid skirt supporting rib 218, and a lid underhang 250. The outer lid skirt 215 includes a tear strip 225. The tear strip 255 includes an upper tear line 227 and lower tear line 228. A retention hook 235 is included at the bottom edge of the lid skirt 215 below the lower tear line 228.

In the illustrated embodiment, the lid underhang 250 has an upper surface that engages with a lower surface of the container bead 130, and the top of the outwardly offset portion 111 of the sidewalls 110 fits into a gap between the inner lid skirt 217 and the outer lid skirt 215. The lid underhang 250 and the container bead 130 may form a tight seal and the top of the outwardly offset portion 111 and the gap between the inner lid skirt 217 and the outer lid skirt 215 may form a tight seal.

Figure 13:
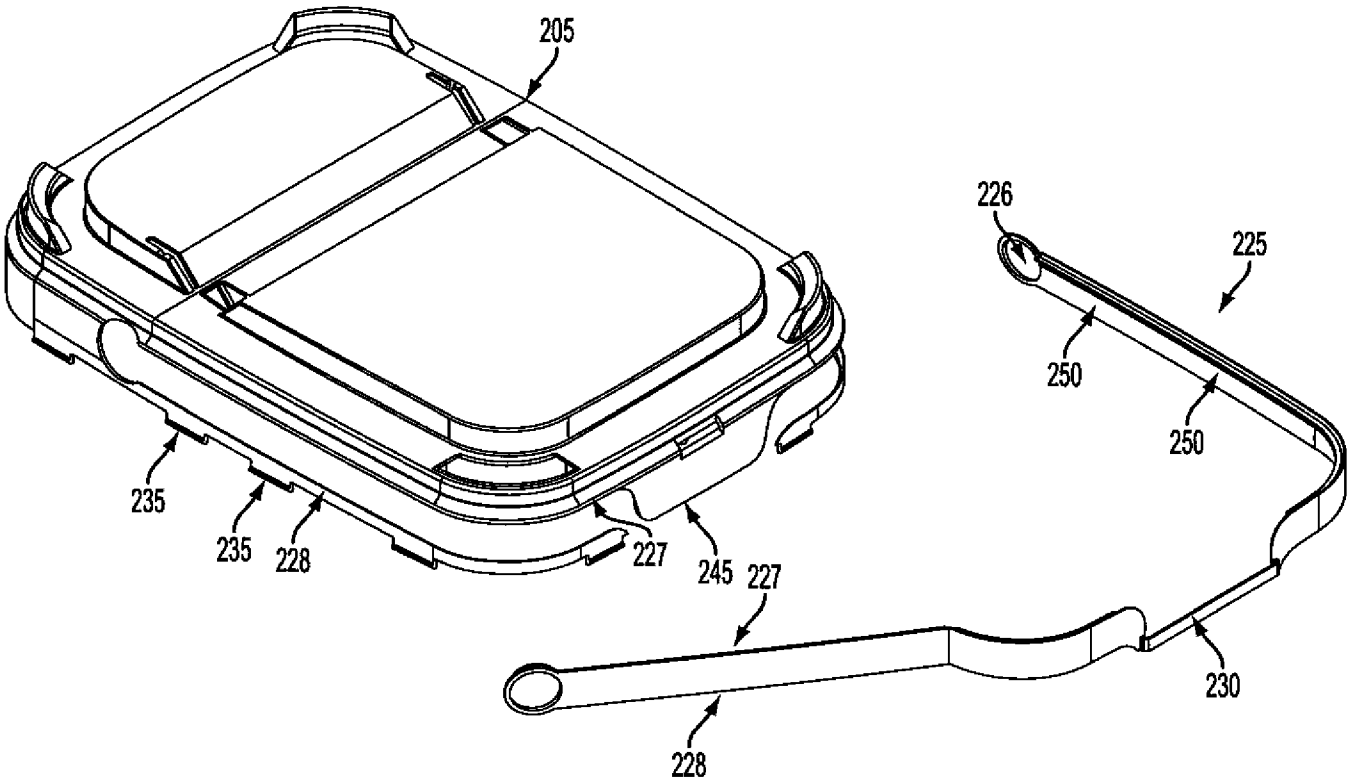
FIG. 13 is a top perspective view of a lid and tear strip according to an embodiment of the present invention.

FIG. 13 is a top perspective view of a lid and tear strip according to an embodiment of the present invention.

As shown in FIG. 13, the tear strip 225 may include a pull ring 226, an upper tear line 227, a lower tear line 228 and a tab cover 230. A lid underhang 250 may be included on the inside surface of the tear strip 225.

Once the tear strip 225 is removed from the lid, the retention hooks 235 are no longer used to hold closed a pivotable portion of the lid body 200. As such the pivotable portion of the lid body 200 may pivot along the lid hinge 205, unhindered by the retention hooks 235.

Figure 14:
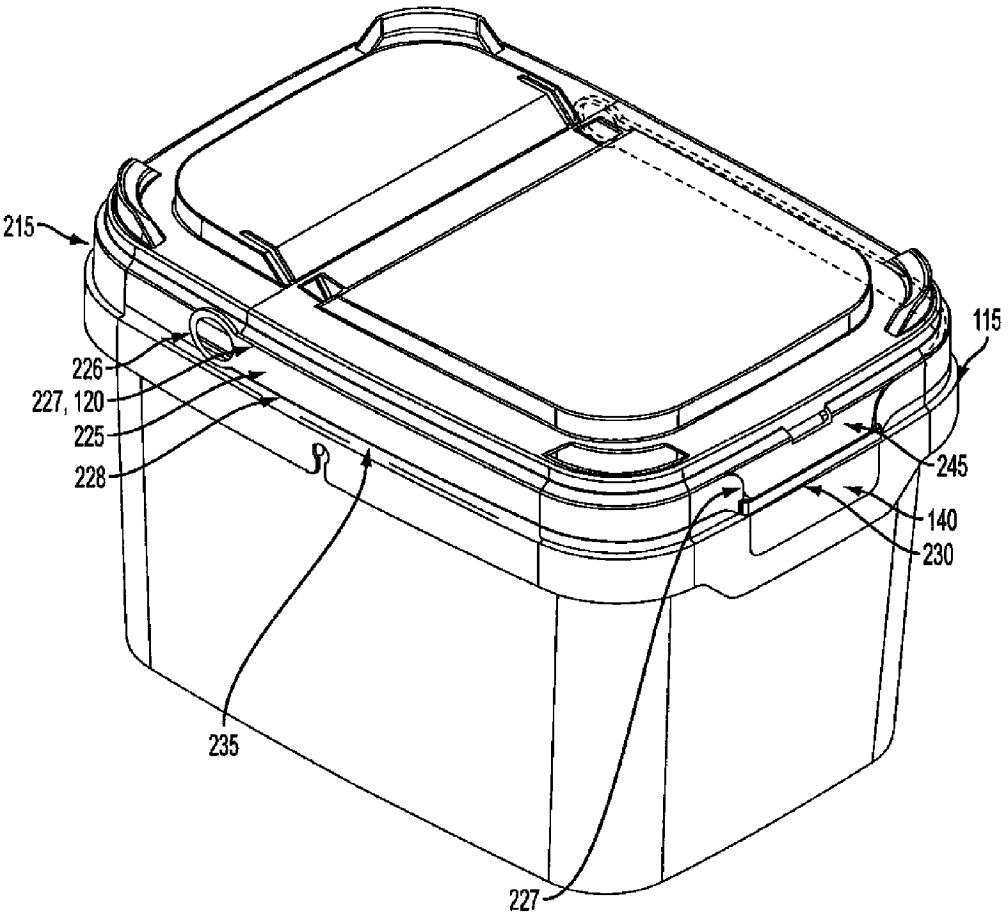
FIG. 14 is a top perspective view of a container, lid and tear strip according to an embodiment of the present invention.
Figure 15:
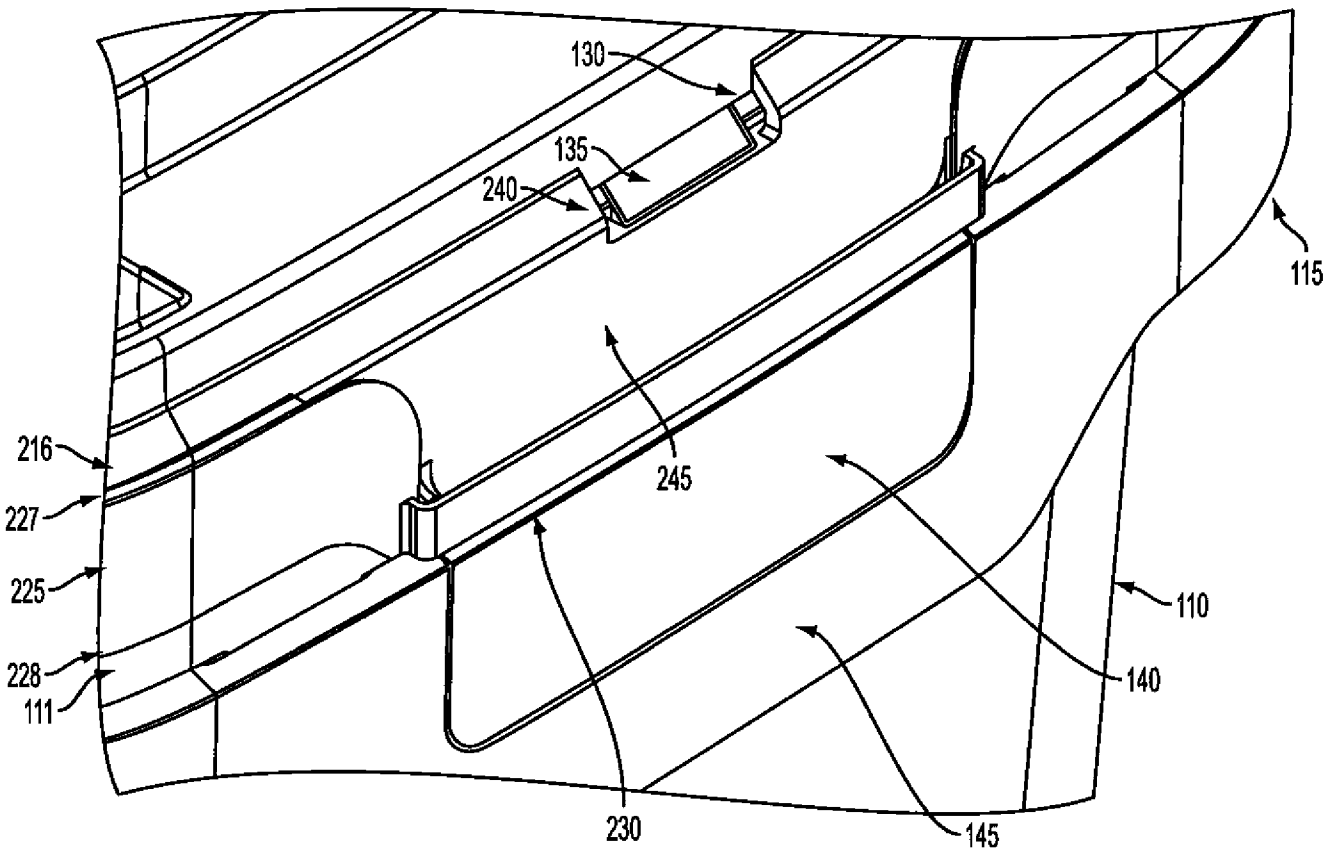
FIG. 15 is a zoomed-in top perspective view of the container, lid and tear strip of FIG. 14.

FIG. 14 is a top perspective view of a container, lid and tear strip according to an embodiment of the present invention, and FIG. 15 is a zoomed-in top perspective view of the container, lid and tear strip of FIG. 14.

As shown in FIGS. 14 and 15, the container may include a tab cover 230. The tab cover 230 may be connected to a tear strip 225 and separated from a lift tab 245. Until the tab cover 230 is removed, the lift tab 245 may be prevented from being lifted outward.

Figure 16:
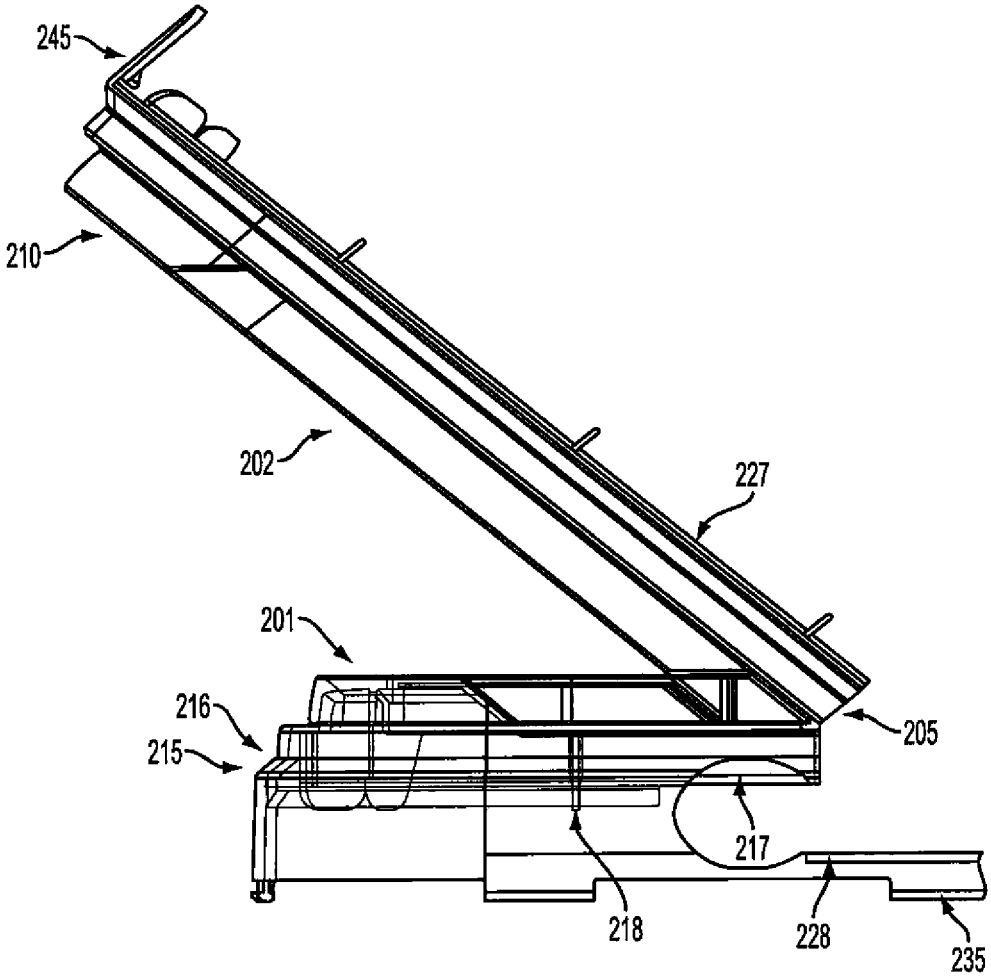
FIG. 16 is a side view of the lid according to an embodiment of the present invention.

FIG. 16 is a side view of the lid according to an embodiment of the present invention.

As shown in FIG. 16, after the tear strip 225 is removed from the lid, the retention hooks 235 no longer hold closed a pivotable portion of the lid body 200. As such the pivotable portion of the lid body 200 may pivot along the lid hinge 205.

Figure 17:
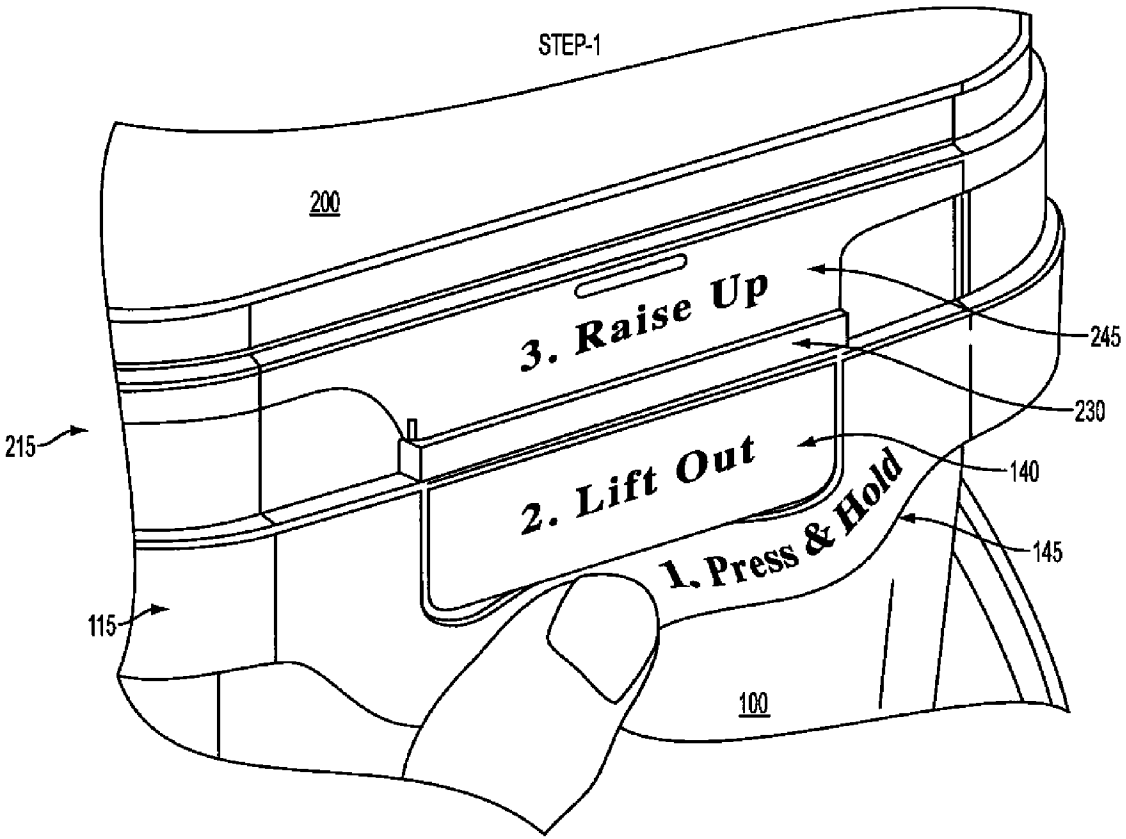
FIG. 17 illustrates a step of a method of opening a container and lid according to an embodiment of the present invention.
Figure 18:
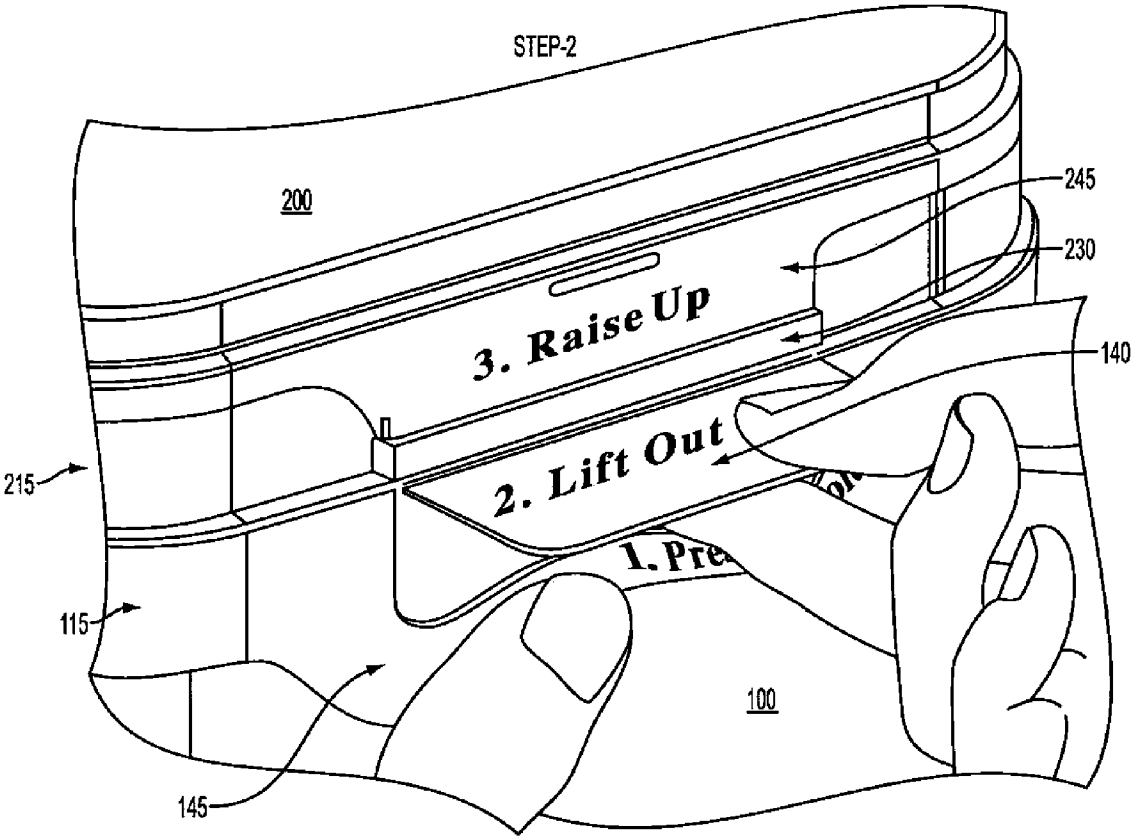
FIG. 18 also illustrates a step of a method of opening a container and lid according to an embodiment of the present invention.
Figure 19:
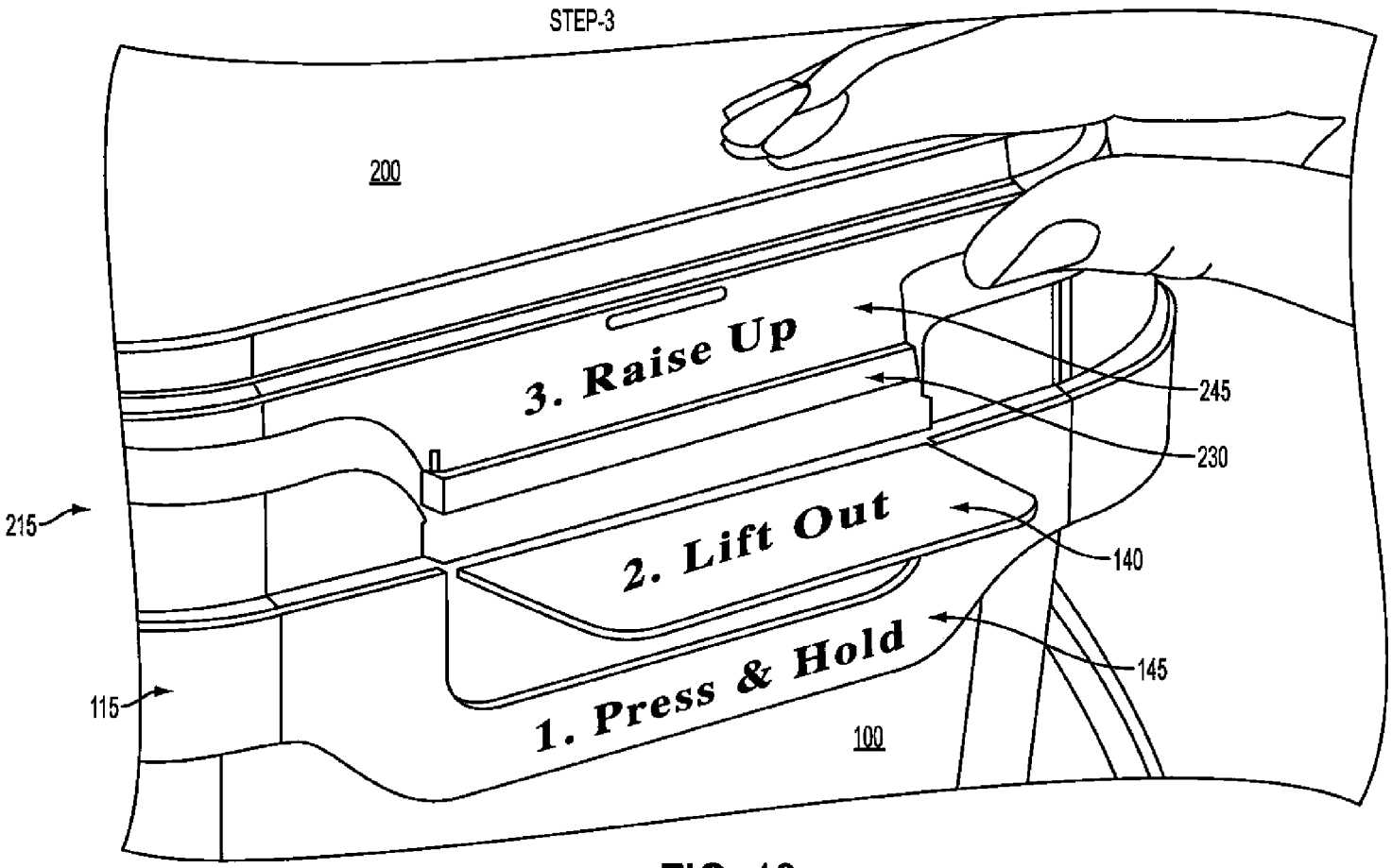
FIG. 19 additionally illustrates a step of a method of opening a container and lid according to an embodiment of the present invention.

FIGS. 17-19 illustrate steps of a method of opening a container and lid according to an embodiment of the present invention As shown in FIG. 17, a method of opening a container according to an embodiment of the present invention includes first pressing a lever guard 145 toward a container body 100, thereby creating access to a pull lever 140. Second, the method includes pulling the pull lever 140 via the created access. The action of pulling the pull lever 140 thereby lifts a lift tab 246, thereby displacing a lid body 200 covering an opening of the container. Finally, the lid may be lifted from the container.

As such, the method of opening the container and lid requires strength for overcoming the resistance at the container tooth 135 and tooth slot 240, and dexterity for pressing the lever guard 145 while lifting the pull lever 140, and logic for understanding the sequence of steps to open the container and lid. Accordingly, the container and lid combines these elements to provide for an effective child resistant closure.

Figure 20:
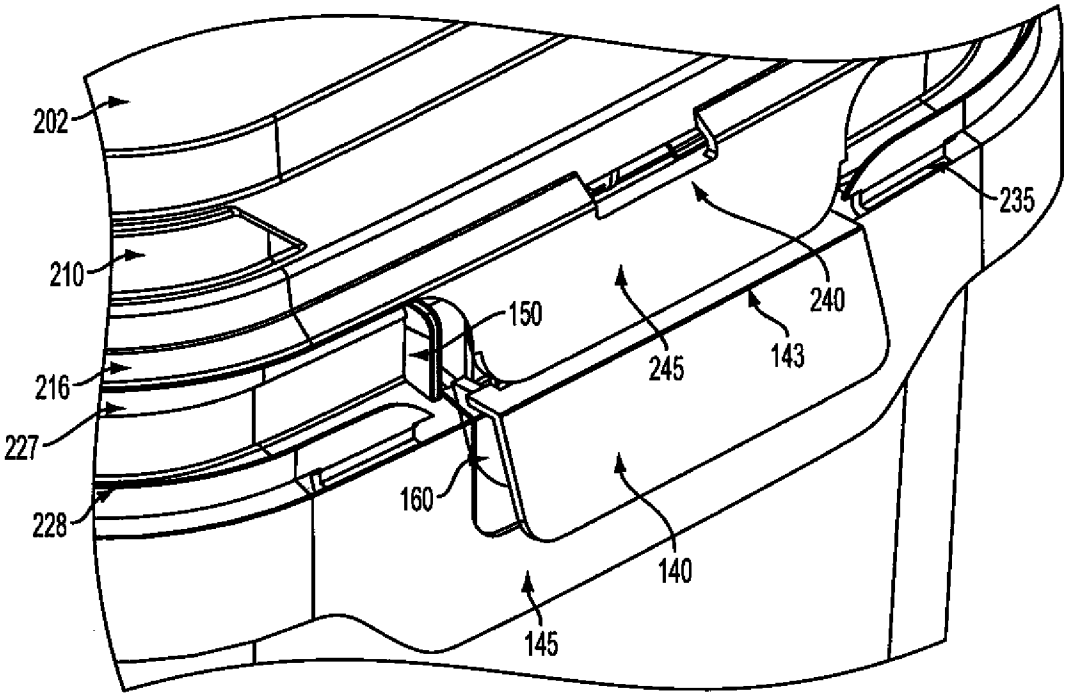
FIG. 20 is a zoomed-in top perspective view of a container and lid according to an embodiment of the present invention.

FIG. 20 is a zoomed-in top perspective view of a container and lid according to an embodiment of the present invention.

As shown in FIG. 20, the container includes a pull lever 140 and a lever guard 145. A push stop 160 may be formed between the pull lever 140 and the sidewalls 110. The lid includes a lift tab 245 including a tooth slot 240.

The container further includes a tab guard 150. The tab guard 150 blocks a lateral access to a space behind the lift tab 245. A second tab guard 150 may be positioned on the opposite side of the lift tab 245.

Figure 21:
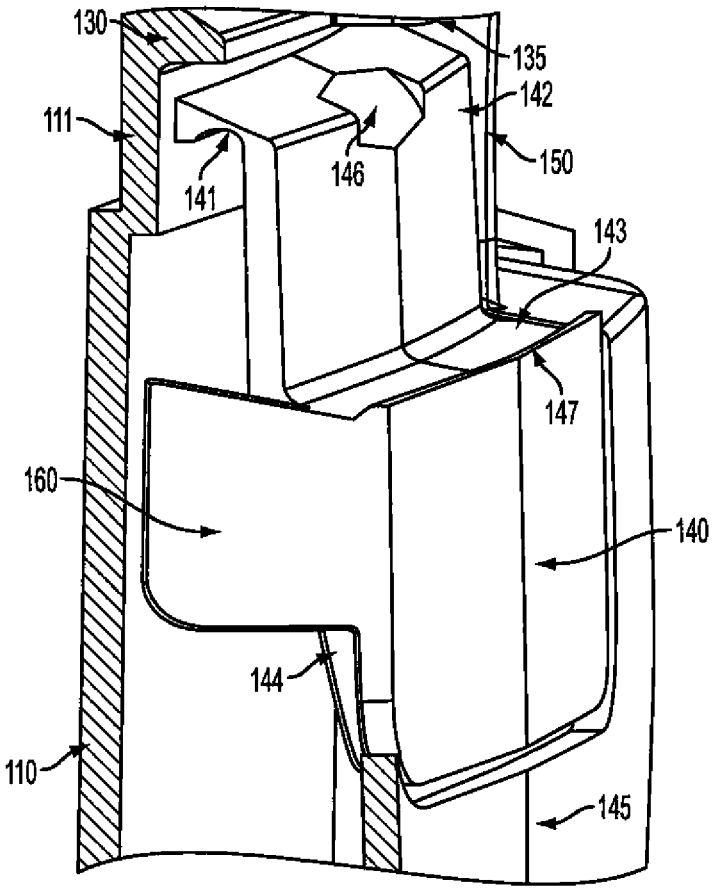
FIG. 21 is a partial sectional view near a lever of a container according to an embodiment of the present invention.

FIG. 21 is a partial sectional view near a lever of a container according to an embodiment of the present invention.

As shown, FIG. 21 illustrates a round portion of container. In the illustrated embodiment, the container includes sidewalls 110. The sidewalls 110 include an outwardly offset portion 111 near the upper edge of the sidewalls 110. The container further includes a container bead 130, a pull lever 140, a push stop 160 and a lever guard 145.

The container may further include a lever recess 146. The lever recess 146 corresponds to the container tooth 135. In the container of FIG. 21, when the pull lever 140 is lifted, the pull lever 140 be lifted so that the pull lever 140 would contact the container tooth 135. However, the lever recess 146 allows the pull lever 140 to be lifted further.

The container of FIG. 21 may further include a lever return 147. The lever return 147 functions to maintain a lift tab 245 of a lid within space above a ledge surface 143 of the pull lever 140 and blocks a user's access to a space between the lift tab 245 and the ledge surface 143.

Figure 22:
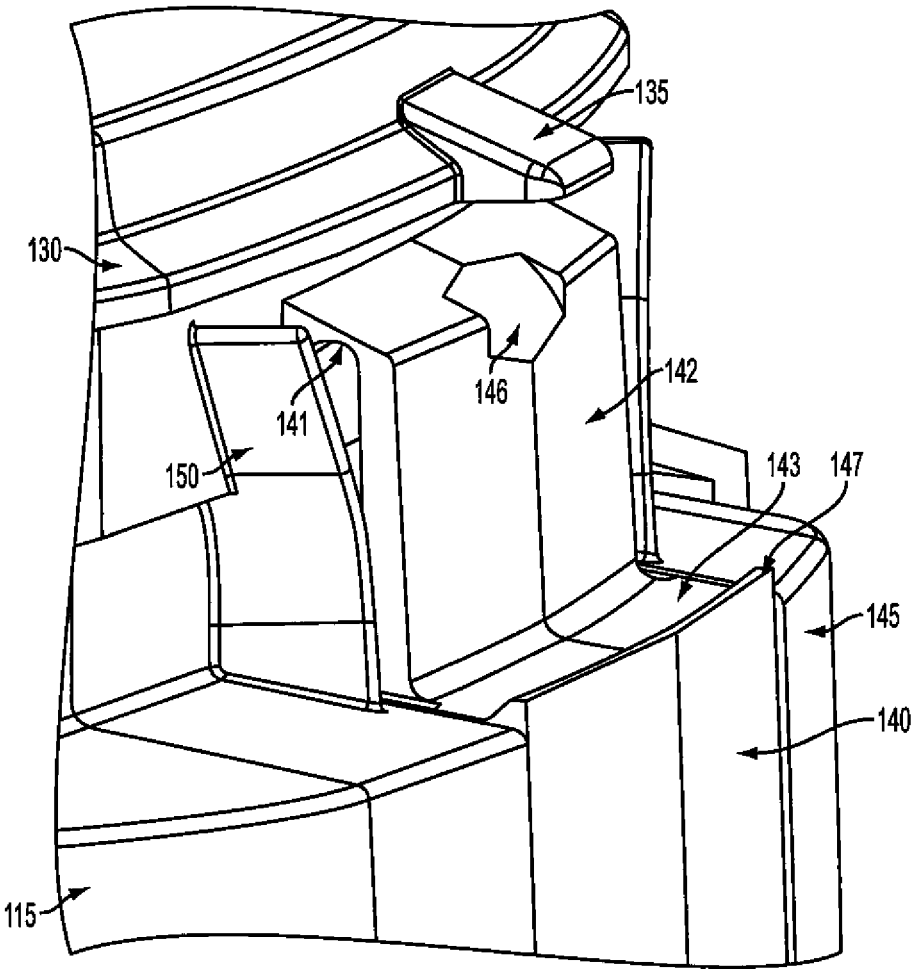
FIG. 22 is another partial sectional view near a pull lever of a container according to an embodiment of the present invention.

FIG. 22 is another partial sectional view near a pull lever of a container according to an embodiment of the present invention.

As shown, FIG. 22 illustrates a round portion of container. In the illustrated embodiment, the container includes sidewalls 110. The sidewalls 110 include an outwardly offset portion 111 near the upper edge of the sidewalls 110. The container further includes a container bead 130 and pull lever 140, and a lever guard 145.

As illustrated, the container may further include a lever recess 146. The lever recess 146 corresponds to the container tooth 135. In the container of FIG. 22, when the pull lever 140 is lifted, the pull lever 140 be lifted so that the pull lever 140 would contact the container tooth 135. However, the lever recess 146 allows the pull lever 140 to be lifted further.

The container of FIG. 22 may further include a lever return 147. The lever return 147 functions to maintain a lift tab 245 of a lid within space above a ledge surface 143 of the pull lever 140 and blocks a user's access to a space between the lift tab 245 and the ledge surface 143.

In FIG. 22, the container further includes a tab guard 150. The tab guard 150 blocks a lateral access to a space behind a lift tab 245. A second tab guard 150 may be positioned on the opposite side of the lift tab 245.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A container and lid, comprising:

a container having:

a container body having a sidewall extending from a base and an opening;

a container bead below un upper rim of the opening and extending around the periphery of the container a container tooth at a periphery of the container body;

a bumper extending from an external surface of the sidewall, the bumper including:

a first bumper portion at a periphery of the container body and having one or more first retention slots; and a second bumper portion at a periphery of the container body and having one or more second retention slots;

a lid having:

a lid body configured to cover the opening of the container body, the lid body including a hinge configured to allow a pivoting portion of the lid body to open while a remaining portion of the lid body remains closed;

a lift tab extending downwardly from a periphery of the pivoting portion of the lid body, wherein the lift tab has a tooth slot therein, wherein the container tooth is configured to extend into the tooth slot, one or more first retention hooks along a periphery of the pivoting portion of the lid body, wherein the one or more first retention slots are configured to receive the one or more first retention books; and one or more second retention hooks along a periphery of the remaining portion of the lid body, wherein the one or more second retention slots are configured to receive the one or more second retention hooks;

a tear strip configured to separate the one or more first retention hooks from the pivoting portion of the lid body;

the container further comprising:

a pull lever having a solid lever bar pivotally attached to an external surface of the sidewall below the container tooth and configured to lift the lift tab by pulling a lower edge of the pull lever in an upward direction, thereby removing the container tooth from the tooth slot in the lift tab; and a depressible lever guard adjacent a lower edge of the pull lever and configured to block access to the lower edge of the pull lever when the lever guard is in a normal state and to allow access to the lower edge of the pull lever when the lever guard is pressed toward the container body.

2. The container and lid of claim 1, further comprising a container bead below an upper rim of the opening and extending around a periphery of the container body.

3. The container and lid of claim 2, further comprising a lid underhang at an interior of the lift tab and the tear strip, wherein the lid underhang is configured to contact the container head.

4. The container and lid of claim 2, wherein the container tooth is an extension of the container bead.

5. The container and lid of claim 1, further comprising a tab cover configured to prevent the lifting of the lift tab.

6. The container and lid of claim 1, further comprising tab guards configured to block access to lateral sides of the lift tab.

7. The container and lid of claim 1, further comprising a push stop between the container body and the pull lever.

8. The container and lid of claim 1, further comprising at least one stacking guide on the lid, body.

9. The container and lid of claim 1, further comprising a plastic handle connected at opposing sides of the container body.

10. The container and lid of claim 1, further comprising: a hinge locking rib on the pivoting portion of the lid body; and a hinge locking slot in the remaining portion of the lid body configured to receive the hinge locking rib.

11. The container and lid of claim 1, further comprising: a hinge locking rib on the remaining, portion of the lid body; and a hinge locking slot in the pivoting portion of the lid body configured to receive the hinge locking rib.

12. The container and lid of claim 1, wherein the container body has a substantially rectangular cross-section.

13. The container and lid of claim 1, wherein the container body has a substantially square cross-section.

14. The container and lid of claim 1, wherein the container body has a substantially round cross-section with a substantially square opening.

15. The container and lid of claim 1, wherein the container body has a substantially round cross-section.

16. The container and lid of claim 1, wherein the tear strip extends from a first position along a periphery of the lid to a second position along a periphery of the lid and below the lift tab.

17. The container and lid of claim 5, wherein the tear strip is connected to the tab cover.

18. The container and lid of claim 6, wherein at least one of the tab guards is connected to the container body.

19. The container and lid of claim 6, wherein at least one of the tab guards is connected to the bumper.

20. The container and lid of claim 7, wherein the push stop is connected to the container body.

21. The container and lid of claim 7, wherein the push stop is connected to a lever guard adjacent the pull lever.

22. The container and lid of claim 7, wherein the push stop is connected to the pull lever.

23. The container and lid of claim 7, wherein the push stop is a rib extended between the pull lever and the container body.

24. The container and lid of claim 5, wherein the tear strip is frangibly connected to the tab cover.

25. The container and lid of claim 5, wherein the tear strip is non-frangibly connected to the tab cover.

26. The container and lid of claim 5, wherein the tab cover is connected to the lift tab.

27. The container and lid of claim 5, wherein the tab cover is separate from the lift tab.

* * * * *